US010456637B2

(12) United States Patent
Becktor et al.

(10) Patent No.: US 10,456,637 B2
(45) Date of Patent: Oct. 29, 2019

(54) PUTTER-TYPE GOLF CLUB HEAD

(71) Applicant: DUNLOP SPORTS CO. LTD., Kobe-shi, Hyogo (JP)

(72) Inventors: Mika Becktor, Costa Mesa, CA (US); Keith Dolezel, West Covina, CA (US); Nick Trahan, Huntington Beach, CA (US); Phillip C. Seagram, Long Beach, CA (US); Brian Herr, Tustin, CA (US); Jeff Brunski, Los Angeles, CA (US); Adam Sheldon, Long Beach, CA (US)

(73) Assignee: SUMITOMO RUBBER INDUSTRIES, LTD., Kobe (JP)

( * ) Notice: Subject to any disclaimer, the term of this patent is extended or adjusted under 35 U.S.C. 154(b) by 0 days.

(21) Appl. No.: 15/813,944

(22) Filed: Nov. 15, 2017

(65) Prior Publication Data

US 2018/0071596 A1 Mar. 15, 2018

Related U.S. Application Data

(63) Continuation of application No. 14/311,047, filed on Jun. 20, 2014, now Pat. No. 9,839,822, which is a (Continued)

(51) Int. Cl.
*A63B 53/04* (2015.01)
*A63B 69/36* (2006.01)

(52) U.S. Cl.
CPC .. *A63B 53/0487* (2013.01); *A63B 2053/0433* (2013.01); *A63B 2053/0437* (2013.01); (Continued)

(58) Field of Classification Search
USPC ..... 473/324–350
See application file for complete search history.

(56) References Cited

U.S. PATENT DOCUMENTS 1,291,967 A * 1/1919 McDougal ..... A63B 53/0487 473/251
D58,209 S * 6/1921 Bacheller ..... 473/251
(Continued)

FOREIGN PATENT DOCUMENTS

JP 2008168139 A * 7/2008
WO 2006113966 A1 11/2006
WO WO 2006113966 A1 * 11/2006 ..... A63B 69/3685

OTHER PUBLICATIONS

Feb. 5, 2018 Office Action Issued in U.S. Appl. No. 15/481,902.
(Continued)

*Primary Examiner* — Alvin A Hunter
(74) *Attorney, Agent, or Firm* — Oliff PLC

(57) ABSTRACT

A putter-type golf club head is disclosed. When oriented in a reference position, the putter-type golf club head comprises a blade member and a central elongate member in communication with, and extending rearwardly from, the blade member. The blade member extends in a heel-to-toe direction and has a striking wall defining a substantially planar striking surface, and an upper surface of the central elongate member comprises at least one generally square-shaped alignment element.

17 Claims, 28 Drawing Sheets

Related U.S. Application Data continuation-in-part of application No. 14/166,289, filed on Jan. 28, 2014, now Pat. No. 9,694,259.

(60) Provisional application No. 61/891,639, filed on Oct. 16, 2013.

(52) U.S. Cl.
CPC ..... *A63B 2053/0441* (2013.01); *A63B 2069/3682* (2013.01)

(56) References Cited

U.S. PATENT DOCUMENTS

D205,041 S * 6/1966 Capps ..... 473/252
3,333,854 A * 8/1967 White ..... A63B 53/0487 473/249
3,880,430 A * 4/1975 McCabe ..... A63B 69/3685 473/253
4,312,509 A 1/1982 Grant
4,629,193 A * 12/1986 Pierman ..... A63B 69/3685 473/254
4,688,798 A 8/1987 Pelz
4,754,976 A * 7/1988 Pelz ..... A63B 53/0487 473/249
4,795,157 A * 1/1989 Bencriscutto ..... A63B 69/3685 473/251
4,964,639 A * 10/1990 Tucker ..... A63B 53/007 473/255
5,046,740 A * 9/1991 D'Eath ..... A63B 53/0487 473/255
5,167,414 A * 12/1992 Montgomery, III ..... A63B 53/0487 473/251
5,470,070 A * 11/1995 Bendo ..... A63B 53/0487 473/252
5,533,728 A * 7/1996 Pehoski ..... A63B 53/0487 473/252
5,676,603 A * 10/1997 Miller ..... A63B 69/3614 473/220
5,716,290 A * 2/1998 Baker ..... A63B 53/0487 273/DIG. 8
D398,353 S * 9/1998 Wooten ..... D21/742
5,816,930 A 10/1998 Brown
D401,636 S * 11/1998 Duclos ..... D21/742
5,842,935 A * 12/1998 Nelson ..... A63B 53/0487 473/342
5,890,969 A * 4/1999 Bechler ..... A63B 53/007 473/255
6,045,452 A * 4/2000 Ahn ..... A63B 53/0487 473/249
6,062,986 A * 5/2000 Kaise ..... A63B 53/0487 473/242
D429,297 S 8/2000 Hettinger
D441,042 S 4/2001 Hettinger
D443,320 S 6/2001 Breier et al.
D443,906 S 6/2001 Hettinger et al.
6,273,831 B1 8/2001 Dewanjee
D447,782 S 9/2001 Hettinger et al.
D449,085 S 10/2001 Breier et al.
D457,586 S 5/2002 Tang et al.
6,386,991 B1 * 5/2002 Reyes ..... A63B 53/0487 473/340
D458,656 S 6/2002 Tang et al.
6,422,949 B1 * 7/2002 Byrne ..... A63B 69/3688 473/200
6,422,950 B1 * 7/2002 Whitlam ..... A63B 53/02 473/313
D461,514 S 8/2002 Tang et al.
D461,515 S 8/2002 Tang et al.
D461,860 S 8/2002 Tang
D461,861 S 8/2002 Tang et al.
D462,100 S 8/2002 Breier et al.
D463,002 S 9/2002 Tang et al.
6,471,600 B2 * 10/2002 Tang ..... A63B 53/04 473/242
D467,985 S 12/2002 Tang et al.
6,506,125 B2 * 1/2003 Helmstetter ..... A63B 53/04 473/242
D470,904 S 2/2003 Tang et al.
D471,245 S 3/2003 Tang et al.
D471,940 S 3/2003 Tang et al.
D472,594 S 4/2003 Tang et al.
D472,595 S 4/2003 Tang et al.
D481,089 S 10/2003 Breier et al.
6,663,497 B2 * 12/2003 Cameron ..... A63B 53/065 473/245
D485,320 S 1/2004 Breier et al.
D485,323 S 1/2004 Wagner et al.
D485,592 S 1/2004 Hettinger et al.
6,679,782 B2 * 1/2004 Tang ..... A63B 53/04 473/242
D486,194 S 2/2004 Helmstetter et al.
6,685,577 B1 * 2/2004 Scruggs ..... A63B 53/00 473/349
6,692,372 B1 2/2004 Colucci
D488,200 S 4/2004 Olsavsky et al.
6,716,110 B1 * 4/2004 Ballow ..... A63B 53/065 473/242
D496,417 S 9/2004 Tang
D496,418 S 9/2004 Tang et al.
6,793,588 B2 9/2004 Tang et al.
D499,777 S * 12/2004 Yamamoto ..... D21/742
6,837,801 B1 * 1/2005 Souza ..... A63B 53/0487 473/251
D505,703 S 5/2005 Fiskari
D506,237 S 6/2005 Byrne et al.
6,905,420 B2 6/2005 Tang et al.
D507,319 S * 7/2005 Kramski ..... D21/744
D508,546 S 8/2005 Oldknow
D508,723 S 8/2005 Rollinson et al.
6,926,615 B1 * 8/2005 Souza ..... A63B 53/0487 473/251
6,929,564 B2 8/2005 Olsavsky et al.
6,960,140 B2 11/2005 Solheim et al.
6,974,394 B1 12/2005 Tang et al.
D513,777 S 1/2006 Cuellar
D514,182 S 1/2006 Olsavsky et al.
6,988,955 B2 * 1/2006 Stoakes ..... A63B 53/0487 473/242
D515,647 S 2/2006 Morgulis
7,004,849 B2 * 2/2006 Cameron ..... A63B 53/0487 473/249
D517,143 S 3/2006 Petsel et al.
7,018,304 B2 * 3/2006 Bradford ..... A63B 53/065 473/334
D519,180 S 4/2006 Oldknow
D520,583 S * 5/2006 Rollinson ..... D21/742
7,052,410 B2 5/2006 Cameron
7,052,411 B2 5/2006 Solheim et al.
D523,102 S * 6/2006 Stites ..... D21/742
7,070,516 B2 7/2006 Dewanjee et al.
7,086,957 B2 8/2006 Solheim et al.
D532,066 S 11/2006 Tang
D532,467 S 11/2006 Aguinaldo et al.
D532,844 S 11/2006 Rollinson
D532,845 S 11/2006 Rollinson
D532,847 S 11/2006 Rollinson
D533,242 S 12/2006 Tang
D533,244 S 12/2006 Kroll, Jr.
D533,613 S 12/2006 Byrne et al.
D533,913 S 12/2006 Byrne et al.
7,147,569 B2 * 12/2006 Tang ..... A63B 53/0487 473/249
D534,974 S 1/2007 Haack
7,163,469 B2 1/2007 Bonneau
7,166,036 B2 * 1/2007 Byrne ..... A63B 53/0487 473/242
7,166,039 B2 1/2007 Hettinger et al.
7,169,061 B2 * 1/2007 Hou ..... A63B 53/0487 473/341
D539,860 S 4/2007 Fussell

(56) References Cited

U.S. PATENT DOCUMENTS 7,232,379 B2 6/2007 Riseley
D548,295 S 8/2007 Jertson et al.
D548,296 S 8/2007 Rollinson
D549,795 S 8/2007 Rollinson
D552,197 S 10/2007 Wells et al.
D552,699 S 10/2007 Rollinson
D552,700 S 10/2007 Rollinson
D557,361 S 12/2007 Rollinson
D561,282 S 2/2008 Rollinson
D562,926 S 2/2008 Roberts et al.
7,326,121 B2 * 2/2008 Roake ..... A63B 53/065 473/251
D564,606 S 3/2008 Oldknow et al.
7,344,451 B2 * 3/2008 Tang ..... A63B 53/0487 473/340
D565,681 S 4/2008 Tanaka
D568,427 S 5/2008 Nguyen et al.
D569,462 S 5/2008 Rollinson
D571,878 S 6/2008 Jones et al.
7,387,580 B2 * 6/2008 Hasegawa ..... A63B 53/0487 473/340
D572,331 S 7/2008 Oldknow et al.
D572,780 S 7/2008 Rollinson
D573,673 S 7/2008 Noyes
D574,908 S 8/2008 Hettinger et al.
D575,366 S 8/2008 Rollinson
D577,085 S 9/2008 Nicolette et al.
D577,398 S 9/2008 Hilton
7,435,188 B2 * 10/2008 Tateno ..... A63B 53/0487 473/340
D579,995 S 11/2008 Nicolette et al.
D581,477 S 11/2008 Burdick
7,455,599 B2 * 11/2008 Jones ..... A63B 53/0487 473/340
D582,497 S 12/2008 Rollinson
7,473,188 B2 * 1/2009 Nishino ..... A63B 53/0487 473/340
7,481,713 B2 1/2009 Beckman
7,491,135 B1 * 2/2009 Rollinson ..... A63B 53/0487 473/342
D588,657 S 3/2009 Hettinger et al.
D589,575 S 3/2009 Kim et al.
D590,034 S 4/2009 Foster et al.
D590,035 S 4/2009 Hilton
D590,461 S 4/2009 Kim et al.
D590,462 S 4/2009 Hettinger et al.
D591,371 S 4/2009 Hilton
D591,372 S 4/2009 Tang et al.
D591,806 S 5/2009 Cameron
D591,807 S 5/2009 Rollinson
D592,717 S 5/2009 Rollinson
D594,517 S 6/2009 Tang et al.
D595,372 S 6/2009 Rollinson
D595,373 S 6/2009 Kim et al.
7,540,810 B2 6/2009 Hettinger et al.
D595,793 S 7/2009 Rollinson
7,578,752 B1 * 8/2009 Flores ..... A63B 53/0487 473/251
D599,425 S 9/2009 Laub
7,588,499 B2 * 9/2009 Tateno ..... A63B 53/0487 473/251
D603,006 S 10/2009 Foster et al.
7,611,419 B2 * 11/2009 O'Neill ..... A63B 53/04 473/242
7,625,299 B2 * 12/2009 Fujimoto ..... A63B 53/0487 473/340
D616,513 S 5/2010 Feret
D617,857 S * 6/2010 Sones ..... D21/746
D619,665 S 7/2010 Rollinson et al.
7,766,762 B2 * 8/2010 Stellander ..... A63B 53/0487 473/251
D630,690 S 1/2011 Rollinson
D634,801 S 3/2011 Rollinson
D635,625 S 4/2011 Rollinson
7,918,745 B2 * 4/2011 Morris ..... A63B 53/0487 473/252
D638,892 S 5/2011 Hettinger et al.
D640,341 S 6/2011 Foster et al.
7,955,180 B2 * 6/2011 Bittner ..... A63B 53/0487 473/242
D641,057 S 7/2011 Rollinson
D641,438 S 7/2011 Rollinson
D641,439 S 7/2011 Rollinson et al.
D641,440 S 7/2011 Hettinger et al.
D641,441 S 7/2011 Hilton et al.
D641,442 S 7/2011 Rollinson
D641,814 S 7/2011 Hilton et al.
D641,815 S 7/2011 Rollinson et al.
D650,459 S 12/2011 Rollinson
8,246,481 B2 * 8/2012 Stites ..... A63B 53/007 473/242
8,251,836 B2 * 8/2012 Brandt ..... A63B 53/007 473/340
8,282,501 B2 * 10/2012 Smith ..... A63B 53/02 473/251
8,506,415 B2 * 8/2013 Franklin ..... A63B 53/0487 473/251
D709,971 S * 7/2014 Trahan ..... D21/759
D709,972 S * 7/2014 Trahan ..... D21/759
D709,973 S * 7/2014 Trahan ..... D21/759
8,834,285 B2 * 9/2014 Franklin ..... A63B 53/0487 473/251
8,900,064 B2 * 12/2014 Franklin ..... A63B 53/0487 473/251
8,905,857 B1 * 12/2014 Eckhart ..... A63B 53/0487 473/244
8,956,245 B2 * 2/2015 Brandt ..... A63B 53/007 473/340
D730,462 S * 5/2015 Becktor ..... D21/742
D730,463 S * 5/2015 Dolezel ..... D21/742
D732,120 S * 6/2015 Becktor ..... D21/742
D732,121 S * 6/2015 Trahan ..... D21/742
D732,122 S * 6/2015 Becktor ..... D21/742
D732,618 S * 6/2015 Becktor ..... D21/742
D749,685 S * 2/2016 Dolezel ..... D21/759
D757,193 S 5/2016 Dolezel
9,474,948 B2 * 10/2016 Dolezel ..... A63B 53/0487
9,694,259 B2 * 7/2017 Trahan ..... A63B 53/0487
9,782,645 B2 * 10/2017 Dolezel ..... A63B 53/0487
9,839,822 B2 * 12/2017 Becktor ..... A63B 53/0487
2002/0049093 A1 * 4/2002 Reyes ..... A63B 53/0487 473/324
2004/0132542 A1 * 7/2004 Olsavsky ..... A63B 53/0487 473/336
2005/0003902 A1 * 1/2005 Reese ..... A63B 53/0487 473/340
2009/0111605 A1 * 4/2009 Fujimoto ..... A63B 53/0487 473/340
2009/0215547 A1 * 8/2009 Hegarty ..... A63B 69/3685 473/219
2010/0173720 A1 7/2010 Kim

OTHER PUBLICATIONS

May 12, 2016 Office Action issued in U.S. Appl. No. 14/166,289.
Jun. 16, 2016 Office Action issued in U.S. Appl. No. 14/311,047.
Oct. 11, 2016 Office Action issued in U.S. Appl. No. 14/166,289.
Dec. 30, 2016 Office Action issued in U.S. Appl. No. 14/311,047.
Dec. 29, 2016 Notice of Allowance issued in U.S. Appl. No. 14/166,289.

* cited by examiner

PUTTER-TYPE GOLF CLUB HEAD

RELATED APPLICATION

This application is a continuation of U.S. patent application Ser. No. 14/311,047, filed Jun. 20, 2014, which in turn claims benefit of U.S. Provisional Application No. 61/891,639, filed Oct. 16, 2013, entitled "Putter-Type Golf Club Head" and is also a continuation-in-part of U.S. application Ser. No. 14/166,289, filed Jan. 28, 2014, and also entitled "Putter-Type Golf Club Head." A claim of priority to these prior applications is hereby made, and the disclosures of these prior applications are hereby incorporated by reference.

BACKGROUND

A critical component of effective putting is the ability to properly align a putter-type golf club with the cup. To better facilitate this proper alignment, various solutions have previously been proposed and manufactured. For example, as evidenced by U.S. Pat. Nos. D401,636 and D429,297, a putter-type golf club head has been produced with grooves on its upper surface that are perpendicular to the striking surface of the club head. As evidenced by U.S. Pat. Nos. 6,905,420 and 6,679,782, a putter-type golf club head has also been produced with a "2-ball" design, in which multiple circular elements are provided on the upper surface of the club head. These circular elements are typically centered on an imaginary vertical plane extending rearwardly and perpendicularly from a center point of the striking surface of the putter-type club head. Such design attempts do not, however, adequately provide feedback to the golfer in a manner that avoids strain and unnecessary mental computation. The result is a golfer's loss of confidence in his equipment and greater difficulty in applying a smooth and accurate putting stroke.

SUMMARY

The conventional grooves and circular alignment elements often fail to result in effective alignment of the putter-type golf club head with the cup, thereby frequently resulting in erroneous shots. Accordingly, it may be an object of the present invention to provide a putter-type golf club head with more effective alignment elements.

According to experiments carried out by the present inventors, the presence of at least one rectangular alignment element, such as a rectangle or square, may allow a golfer to more effectively align the putter-type golf club head with the cup than the "2-ball" design. One explanation for this improvement is the right-angle characteristic of rectangles and squares, in which at least one visual indicator section, for example an edge, of the at least one alignment element was parallel to the striking surface of the club head and at least one other visual indicator section extended parallel to the travelling direction of the golf ball. Also according to the experiments carried out by the present inventors, by making the width of the at least one alignment element substantially equal to the diameter of the golf ball, heel-to-toe (translational) alignment was improved, thereby further reducing the likelihood of off-centered shots.

Thus, one example of the putter-type golf club head according to one or more aspects of the present disclosure may include a blade member extending in a heel-to-toe direction and having a striking wall defining a substantially planar striking surface. A central elongate member may be in communication with, and may extend rearwardly from, the blade member. And an upper surface of the central elongate member may comprise at least one generally square-shaped alignment element.

In another example, a putter-type golf club head according to one or more aspects of the present disclosure may include a blade member extending in a heel-to-toe direction and having a striking wall defining a substantially planar striking surface. A central elongate member may be in communication with, and may extend rearwardly from, the blade member. An upper surface of the central elongate member may comprise a first alignment element and a second alignment element, each having a visual indicator portion extending parallel to the striking face and a width in the heel-to-toe direction corresponding to the diameter of a golf ball, wherein: the second alignment element is rearwardly spaced from the first alignment element.

In yet another example, a face-balanced putter-type golf club head according to one or more aspects of the present disclosure may include a generally rectangular blade member extending in a heel-to-toe direction and comprising: a striking wall defining a substantially planar striking surface; a front portion proximate to the striking wall; and a rear portion extending rearwardly from the front portion, an upper surface of the front portion being above an upper surface of the rear portion. The putter-type golf club head may also include a central elongate member that is in communication with, and that extends rearwardly from, the blade member and that has a width in the heel-to-toe direction greater than the diameter of a golf ball, the central elongate member comprising: an upper surface (1) overlapping the upper surface of the rear portion of the blade member and (2) being coplanar with the upper surface of the front portion of the blade member; a bottom surface, the width in the heel-to-toe direction of the upper surface of the central elongate member being greater than the width of the bottom surface; and at least one sidewall that connects the upper surface and the bottom surface of the central elongate member, the at least one sidewall tapering toward a longitudinal vertical center plane of the central elongate member from the upper surface to the bottom surface. The upper surface of the central elongate member may also comprise a first alignment element and a second alignment element each having substantially the same generally square shape, the second alignment element being rearwardly spaced from the first alignment element; forward indicators of the first and second alignment elements being substantially parallel to the striking surface; centers of the first and second alignment elements being intersected by an imaginary vertical plane that (1) is perpendicular to the striking surface, and (2) intersects a center of the striking wall in the heel-to-toe direction; and widths of the first and second alignment elements in the heel-to-toe direction corresponding to the diameter of the golf ball.

These and other features and advantages of the putter-type golf club head according to the various aspects of the present invention will become more apparent upon consideration of the following description, drawings, and appended claims. The drawings described below are for illustrative purposes only and are not intended to limit the scope of the present invention in any manner. It is also to be understood that, for the purposes of this application, any disclosed range encompasses a disclosure of each and every sub-range thereof. For example, the range of 1-5 encompasses a disclosure of at least 1-2, 1-3, 1-4, 2-3, 2-4, 2-5, 3-4, 3-5, and 4-5.

BRIEF DESCRIPTION OF THE DRAWINGS

Exemplary embodiments of the present invention will now be described with reference to the accompanying drawings.

DETAILED DESCRIPTION OF THE EMBODIMENTS

Figure 1:
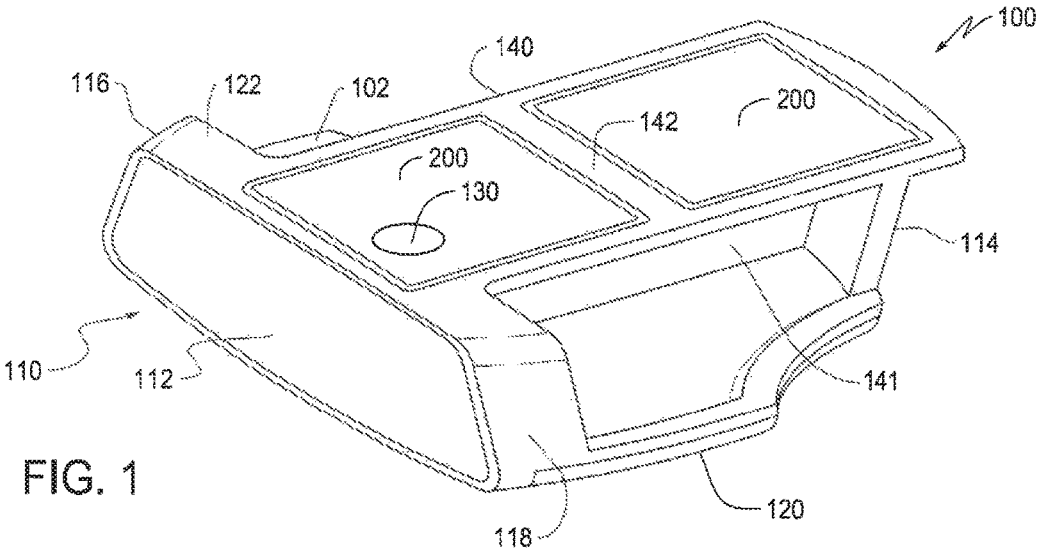
FIG. 1 shows a perspective view of an exemplary putter-type golf club head in accordance with one or more aspects of the present invention.

Referring to FIG. 1, a putter-type golf club head 100 according to one or more aspects of the present invention may generally include a body 102 formed from metallic and/or non-metallic materials. For example, the body 102 may be formed from any one of or a combination of aluminum, stainless steel, titanium, composites, polymeric materials, and/or any other suitable material. The body 102 may include a front portion 110 having a striking wall including a striking surface 112 for contacting a golf ball and an opposing rear surface (not shown), a rear portion 114, a toe portion 116, a heel portion 118, a sole portion 120, and an upper portion 122. The heel portion 118 may include a hosel 130, or aperture extending from the exterior surface of the upper portion 122, configured to receive and secure a shaft (not shown) of the golf club.

As shown, the hosel 130 is located toward the heel portion 118 of the club head 100. In certain other aspects, such as those shown in FIGS. 9-12, the hosel 130 may be located even more toward the heel portion 118. In yet other aspects, the hosel 130 may be located toward the toe portion 116 of the club head 100, or the hosel 130 may be located in a generally central location of the club head 100 relative to the heel to toe direction. In certain aspects, the hosel 130 may extend outward from the upper portion 122 of the club head 100. Specifically, the hosel 130 may comprise a plumber's neck type hosel or a flare-tip type hosel.

The body 102 may also include a central elongate member 140 projecting from the striking surface 112 and/or striking wall of the front portion 110 toward the rear of the body 102. The central elongate member 140 may include a top portion 142, an uppermost surface of which may be substantially planar and may include one or more alignment elements 200. In certain aspects, such as that shown in FIG. 1, the top portion 142 of the central elongate member 140 may be located above, and supported by, a central vertical wall 141 that extends rearwardly from the striking surface 112.

Figure 2:
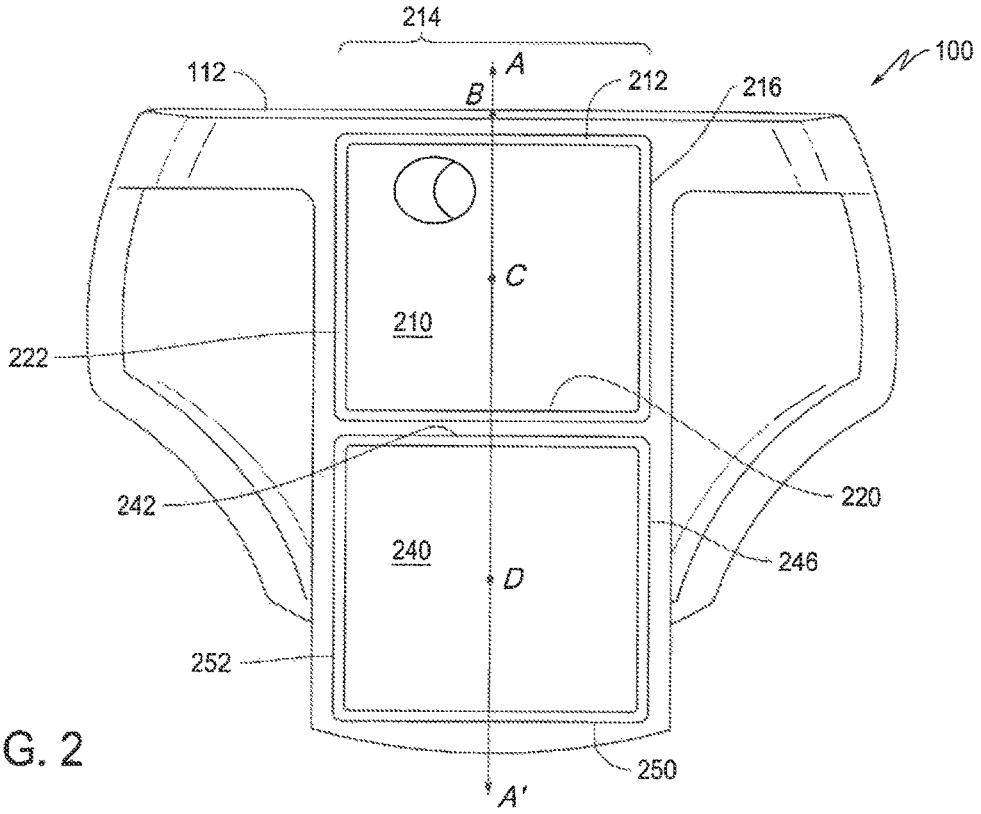
FIG. 2 shows a top plan view of the putter-type golf club head of FIG. 1.

Referring to FIG. 2, the golf club head 100 is shown in top plan view. The golf club head 100 is considered to be in a reference position. "Reference position," as used herein, refers to an orientation of a club head (e.g., club head 100), relative to a ground plane, in which the club head 100 is permitted to rest on the ground plane such that the sole portion 120 of the club head 100 contacts the ground plane at a point midway between a heel-most end of the club head 100 and a toe-most end of the club head 100. Unless otherwise specified, all club head dimensions described herein are taken with the club head in the reference position. In certain aspects, the top portion 142 of the central elongate member 140 may form a generally planar upper surface that optionally is substantially parallel to the ground plane.

The one or more alignment elements 200 may comprise any number and any type of design sufficient to aid a golfer to align the putter-type golf club head 100 with a cup. For example, with further reference to FIG. 2, an alignment element 210 may include a visual indicator section, for example an edge 212, substantially parallel to the striking surface 112. An imaginary vertical plane A-A' may be perpendicular to the general plane of the striking surface 112 when the club head 100 is in the reference position. The edge 212 may be provided so as to be intersected by the imaginary vertical plane A-A' extending perpendicularly thereto and from the striking surface 112 toward the rear portion 114. In certain aspects, the imaginary vertical plane A-A' may intersect a center B of the striking surface 112, and in such cases, it may also bisect the edge 212 (i.e., split the edge 212 into two equal halves). The length 214 of the edge 212 may be chosen to facilitate proper alignment of the golf club head 100 with the golf ball. For example, the length 214 may be equal to or substantially equal to the diameter of a golf ball, 1.62 inches ("in"). Alternatively, the length 214 may be slightly more than or slightly less than the diameter of a golf ball.

The alignment element 210 may also include an additional edge 216 that is substantially perpendicular to the edge 212. In certain aspects, the length of the edge 216 may be, like the length 214 of the edge 212, slightly less than, slightly more than, substantially equal to, or equal to the 1.62-in diameter of a golf ball. The alignment element 210 may also include additional edges. For example, the alignment element 210 may include an edge 220 parallel to the edge 212 and may include an edge 222 parallel to the edge 216. Thus, the alignment element 210 may be rectangular in shape. In certain aspects, the edges 212, 216, 220, and 222 may all be equal in length. Accordingly, the alignment element 210 may be square in shape, and its geometric center C may be positioned on the vertical plane A-A'.

The one or more alignment elements 200 may also comprise an additional alignment element 240. For example, with further reference to FIG. 2, the alignment element 240 may be provided rearward of the alignment element 210. This second alignment element 240 may comprise edges 242, 246, 250, and 252. Edge 242, like edge 212 of the alignment element 210, may be provided substantially parallel to the striking surface 112; may have a length that is slightly less than, slightly more than, substantially equal to, or equal to the 1.62-in diameter of a golf ball; and may be bisected into equal halves by imaginary plane A-A'. Edge 246, like edge 216 of the alignment element 210, may be substantially perpendicular to the edge 242 and may, in certain aspects, have a length equal to that of the edge 242. Edges 250 and 252 may be provided so as to be respectively parallel to edges 242 and 246, thereby providing the alignment element 240 with a rectangular shape. In certain aspects, the edges 242, 246, 250, and 252 may be equal in length. Thus, the alignment element 240 may also be square in shape, and its geometric center D may be positioned on the plane A-A'.

The edges of the alignment elements 200 may be of any kind sufficient to delineate the size and shape of the alignment elements 200. The edges may be formed, for example, as shallow grooves in the top portion 142 of the central elongate member 140. These grooves may have a depth of between 0.25 millimeters ("mm") and 1.00 mm extending from the upper surface of the top portion 142 toward the ground plane. More specifically, these grooves may have a depth substantially equal to 0.50 mm. The depth of the grooves may be selected to be sufficient to enable application and retention of a paint fill. In certain aspects, these grooves are filled with a paint or other organic coating preferably distinguished in appearance from its surrounding environment. In certain aspects, the grooves are partially or entirely filled with a material distinguished in appearance from its surrounding environment, say a colored opaque or translucent polymer.

The presence of the alignment elements 200 on the top portion 142 of the central elongate member 140 may play a role in dictating the shape and dimensions of the putter-type golf club head 100. Notably, the alignment elements 200, as they may comprise plural square-shaped elements with dimensions corresponding to a golf ball diameter, require a relatively large layout area. In turn, these alignment elements 200 may require that a relatively significant amount of mass be placed proximate the top portion 142 of the central elongate member 140. Therefore, given a predetermined mass budget, mass in the remaining regions of the golf club head 100 may preferably be reduced. The walls forming the body 102 of the golf club head 100 may thus be generally thin-walled, and the golf club head 100 may be considered to have a high projected area (as projected into a ground plane when viewed in top plan) to volume ratio. Similarly, the golf club 100 may be considered to have a high length relative to its volume. Exemplary dimensions and properties of the golf club head 100 are discussed in detail below.

The term "volume," as used herein, denotes the volume measured using the conventional water displacement method as specified by the United States Golf Association ("USGA") and the R&A Rules Limited ("R&A"), wherein like features of wood type golf club heads are substituted for those of other types of club heads under consideration (e.g., a putter-type club head).

Figure 3:
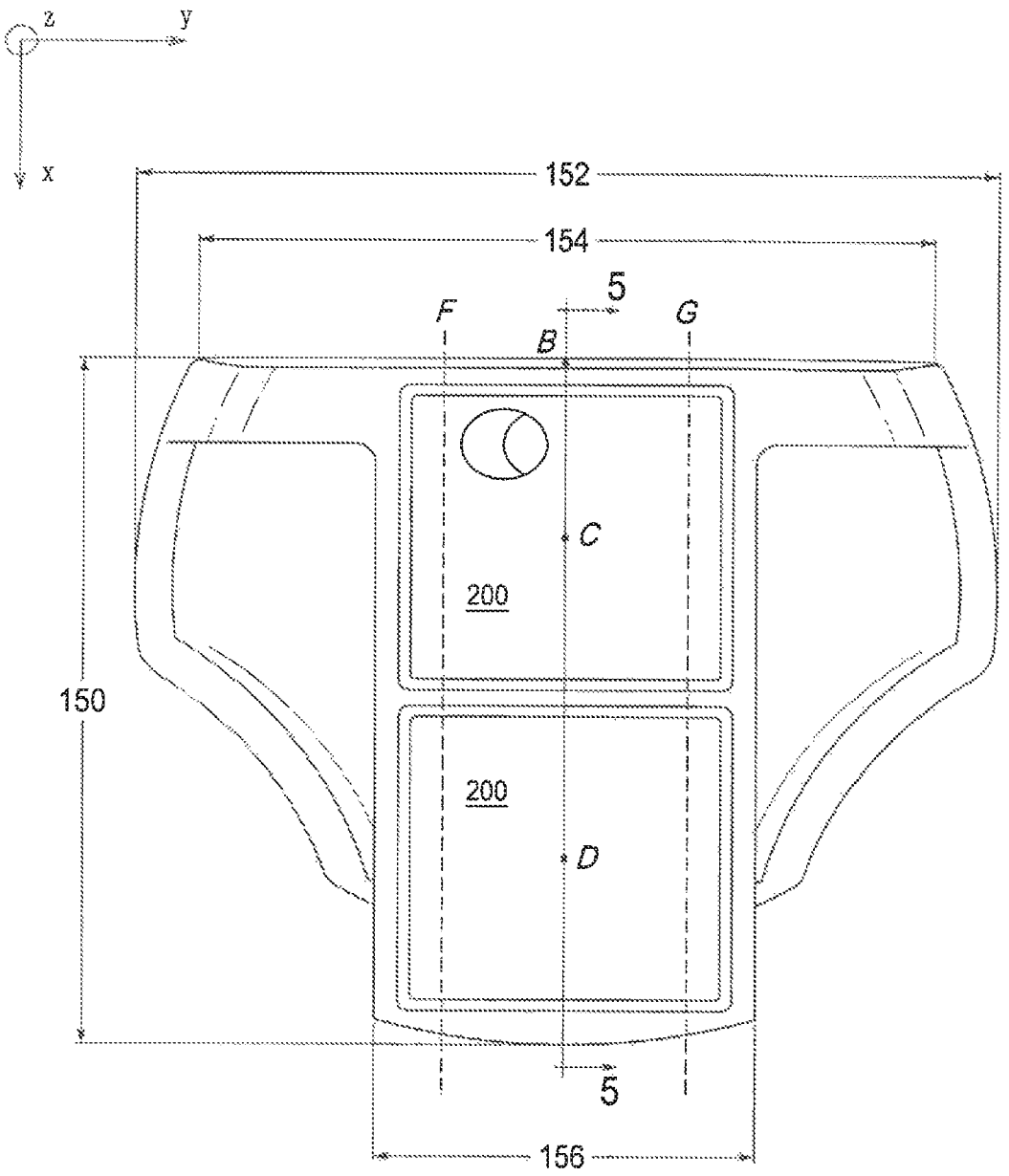
FIG. 3 shows a top plan view of the putter-type golf club head of FIG. 1.

In FIG. 3, the golf club head 100 of FIG. 2 is shown. With reference to the "x" (i.e. front to rear) direction indicated in FIG. 3, an overall length 150 of the body 102 may be greater than or equal to 3.5 in. More specifically, the length 150 may be greater than or equal to 3.55 in. Even more specifically, the length 150 may be between 3.55 and 4.0 in. With reference to the "y" (i.e. heel to toe) direction perpendicular to the "x" direction, the overall width 152 of the body 102 may be, for example, greater than the length 150. In certain aspects, the width 152 may be greater than or equal to 3.8 in. More specifically, the width 152 may be between 4.0 and 4.5 in. Even more specifically, the width 152 may be between 4.1 and 4.4 in. In certain aspects, the product ("*") of the length 150 and the width 152 may be, for example, greater than or equal to 14 $in^2$. More specifically, the product of the length 150 and the width 152 may be between 14 $in^2$ and 20 $in^2$. These dimensions ensure that the desired alignment elements may be properly sized and positioned in a club head that conforms with USGA regulations (and similar regulations of other golf equipment regulatory bodies). Defining a relatively large projected area when viewed in top plan view also ensures that the club head possesses a sufficiently high moment of inertia to provide adequate performance on off-centered shots.

Other dimensions of the body 102 may also be specified. For example, with further reference to FIG. 3, a width 154 of the striking surface 112, taken in a direction parallel to the width 152 (i.e. the heel to toe direction), may be less than or equal to the width 152, preferably less than width 152. More specifically, the width 154 may be greater than or equal to 3.8 in. These dimensions ensure compliance with USGA regulations and, also, instill in the golfer a sense of convergence toward a golf cup, when the club head 100 is viewed from above. This may result in improved accuracy. Furthermore, the width 156 of the central elongate member 140, taken in a direction parallel to the widths 152 and 154, may be less than the widths 152 and 154. In certain aspects, the width 156 may be greater than or equal to 1.0 in. More specifically, the width 156 may be greater than or equal to 1.5 in, or the width 156 may be greater than or equal to 1.75 in. Even more specifically, the width 156 may be between 1.75 and 2.0 in. Finally, the width 156 may be substantially equal to 1.8 in. These parameters, when the club head 100 is viewed from above by a golfer, are believed to ensure continuity between the club head 100 and the golf ball intended to be contacted. Specifically, the bounds of the central elongate member 140, when the club head 100 is in a state of being swung toward a golf ball, are believed to be perceived as motion lines by the golfer. These motion lines could be projected toward the bounds of the golf ball by the golfer with minimal mental exertion. Similarly, having plural alignment elements 200, when the club head 100 is in a state of being swung toward a golf ball, is believed to provide an indication to the golfer of rate of travel with minimal mental exertion, which minimizes over-hitting. Specifically, the cyclical alternations between the surfaces of the alignment elements and the surrounding environment are believed to readily indicate swing speed. This effect is believed to be even further strengthened by the presence of parallel edges 212, 220, 242, and 250.

The projected area of the club head 100 when in a reference position relative to a ground plane, and when viewed in top plan view, may be less than the product of the length 150 and the width 152. For example, the projected area of the club head 100 may be greater than or equal to 50% of the product of the length 150 and the width 152. More specifically, the projected area of the club head 100 may be greater than or equal to 65% of the product of the length 150 and the width 152. Even more specifically, the projected area of the club head 100 may be greater than or equal to 75% of the product of the length 150 and the width 152.

Figure 4:
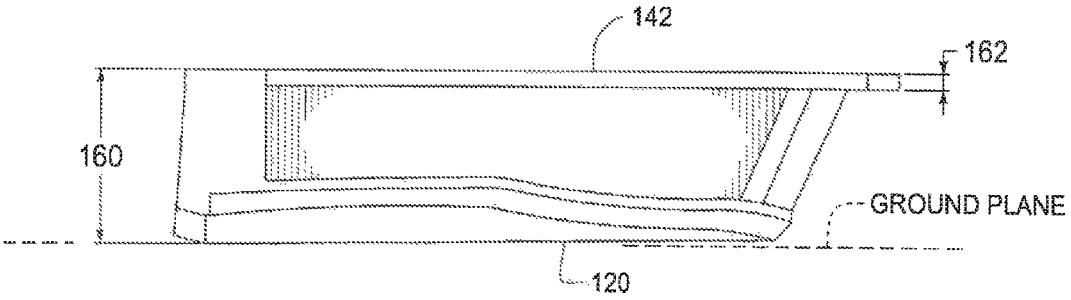
FIG. 4 shows a side view of the putter-type golf club head of FIG. 1.

The height and thickness of the body 102 may also be defined. For example, with reference to FIG. 4, the maximum height 160 from the bottommost point of the sole portion 120 to the uppermost point of the top portion 142 may be greater than or equal to 0.80 in. More specifically, the height 160 may be greater than or equal to 0.85 in. Even more specifically, the height 160 may be greater than or equal to 0.95 in. In certain aspects, the height 160 may be between 0.95 and 1.05 in. The minimum thickness 162 of the top portion 142 may also be specified. For example, the thickness 162 may be less than or equal to 5 mm. More specifically, the thickness 162 may be less than or equal to 3 mm. Even more specifically, the thickness 162 may be between 1 and 3 mm.

Figure 5:
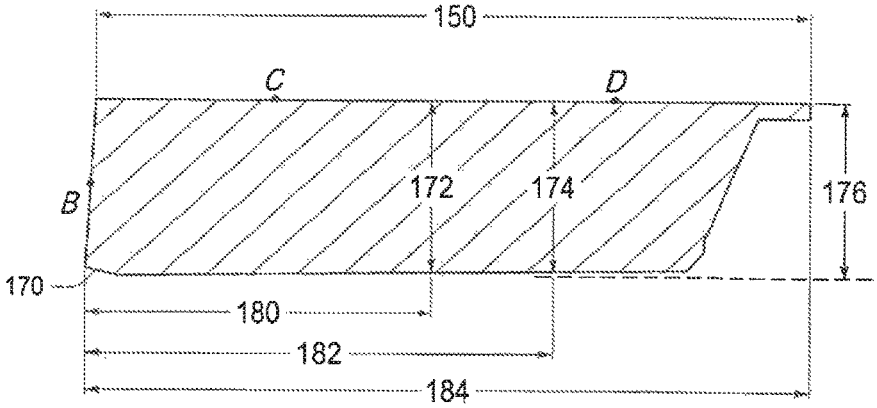
FIG. 5 shows a crosssectional view taken along the line 5-5 of FIG. 3.

FIG. 5 shows a cross-sectional view of the putter-type golf club head 100 along the line 5-5 illustrated in FIG. 3. Although the line 5-5 is shown as intersecting the center B of the striking surface 112 as well as the centers C and D of the alignment elements 200, this need not be the case. Rather, line 5-5 may be positioned anywhere within dashed, imaginary vertical planes F and G, which are each provided 0.5 in from the center B of the striking surface 112. The height 172 is measured at a length 180 (from the forwardmost point 170), which is one half the length 150 of the body 102. The height 172 may be, for example, greater than or equal to the product of 0.5 and the maximum height 160. More specifically, the height 172 may be greater than or equal to the product of 0.75 and the maximum height 160. Even more specifically, the height 172 may be greater than or equal to the product of 0.85 and the maximum height 160. The height 174 is measured at a length 182 (from the forwardmost point 170), which is three-quarters the length 150 of the body 102. The height 174 may be, for example, greater than or equal to the product of 0.5 and the maximum height 160. More specifically, the height 174 may be greater than or equal to the product of 0.75 and the maximum height 160. Even more specifically, the height 174 may be greater than or equal to the product of 0.85 and the maximum height 160. Moreover, the height 176 is measured at a length 184 (from the forwardmost point 170), which is equal to the length 150 of the body 102. The height 176 may be, for example, greater than or equal to the product of 0.5 and the maximum height 160. More specifically, the height 176 may be greater than or equal to the product of 0.75 and the maximum height 160. Even more specifically, the height 176 may be greater than or equal to the product of 0.85 and the maximum height 160.

The provision of the alignment elements 200 may in part dictate other properties of the putter-type golf club head 100. For example, the volume V of the golf club head 100 may be less than or equal to 60 cubic centimeters ("cc"). More specifically, the volume V may be less than or equal to 55 cc. Even more specifically, the volume V may be between 40 and 55 cc. In certain aspects, the volume V may be equal to or about 52 cc. The mass M of the golf club head 100 may be, for example, between 300 and 400 grams ("g"). More specifically, the mass M may be between 340 and 380 g. Even more specifically, the mass M may be substantially equal to or about 360 g. These combined mass and volume parameters ensure that, while keeping manufacturing costs low and maintaining a viable overall mass budget, the alignment features described above may be provided.

Furthermore, with reference to FIG. 3, the moment of inertia $I_{xx}$ of the putter-type golf club head 100 about an axis through the center of gravity of the club head 100 and extending parallel to the x-axis may be, for example, greater than or equal to 2,000 g*cm$^2$. The moment of inertia $I_{yy}$ of the golf club head 100 about an axis through the center of gravity of the club head 100 and extending parallel to the y-axis may be, for example, greater than or equal to 2,200 g*cm$^2$. Finally, the moment of inertia $I_{zz}$ of the golf club head 100 about an axis through the center of gravity of the club head 100 and extending parallel to the z-axis may be, for example, no less than 3,500 g*cm$^2$. More specifically, $I_{zz}$ may be no less than 4,000 g*cm$^2$. Even more specifically, $I_{zz}$ may be between 4,000 and 4,500 g*cm$^2$.

In the above discussion, a non-limiting example of the one or more alignment elements has been described. By virtue of the right-angle characteristics of the alignment elements 200, superior alignment of the putter-type golf club head 100 with the cup may be achieved. Moreover, by virtue of the correspondence between the dimensions of the one or more alignment elements 200 and the diameter of the golf ball, heel-to-toe alignment of the golf ball with the golf club head 100 may be improved, thereby increasing the likelihood of an effective shot.

Figure 6:
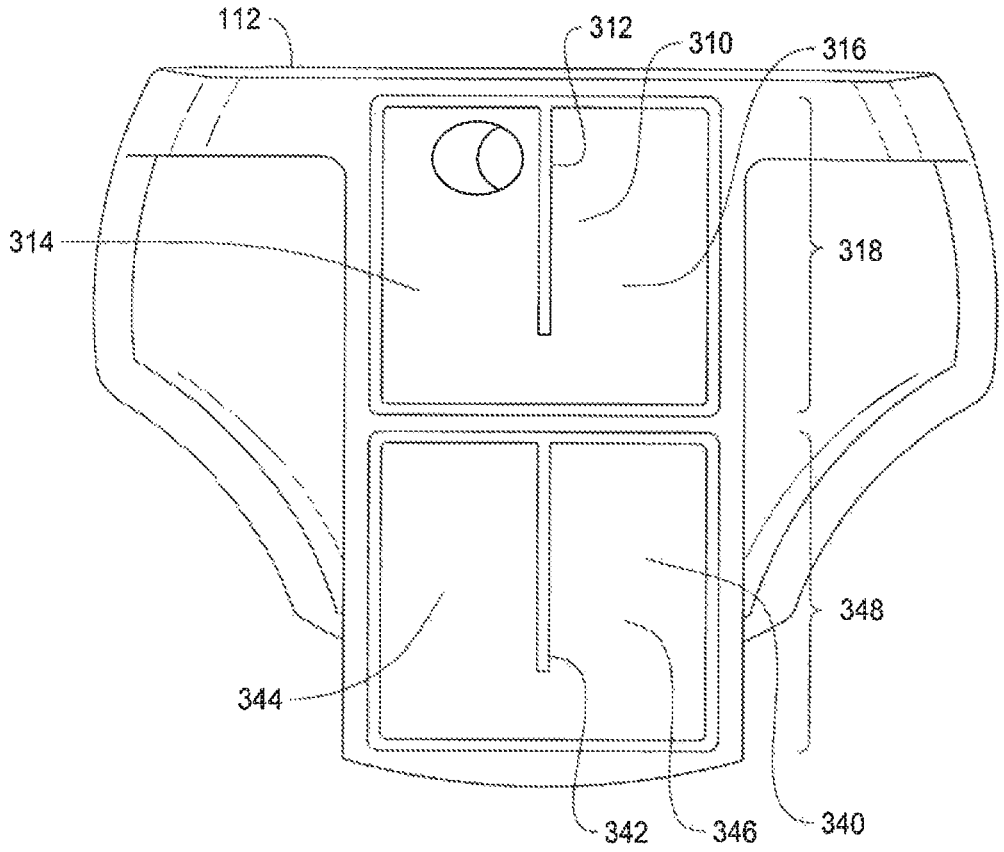
FIG. 6 shows a top plan view of an exemplary putter-type golf club head in accordance with one or more aspects of the present invention.

Other non-limiting examples of the alignment elements are envisioned as being within the scope of the invention. For example, FIG. 6 shows alignment element 310. Alignment element 310 may substantially correspond to alignment element 210 in size and in position on the top portion 142 of the central elongate member 140; however, alignment element 310 may also include a guide line 312. The guide line 312 may be formed in the same manner as the edges of the alignment element 310, say as a groove. As shown in FIG. 6, the guide line 312 may extend perpendicularly to the striking surface 112, and it may run centrally through the alignment element 310 so as to divide the alignment element 310 into two equal portions 314, 316. As shown in FIG. 6, the guide line 312 may extend from the edge of the alignment element 310 closest to the striking surface 112 more than half the length 318 of the alignment element 310 so as to allow the portions 314, 316 to connect. Alternatively, the guide line 312 may extend the entire length 318 of the alignment element 310 so as to completely separate the portions 314, 316. In certain other aspects, the guide line 312 may be intermittent, e.g. dashed.

Another alignment element 340 may also be provided. The alignment element 340 may substantially correspond to alignment element 240 in size and in position on the top portion 142 of the central elongate member 140; however, the alignment element 340 may also include a guide line 342. The guide line 342 may be formed in the same manner as the edges of the alignment element 340, say as a groove. As shown in FIG. 6, the guide line 342 may extend perpendicularly to the striking surface 112, and it may run centrally through the alignment element 340 so as to divide the alignment element 340 into two equal portions 344, 346. As shown in FIG. 6, the guide line 342 may extend from the edge of the alignment element 340 closest to the striking surface 112 more than half the length 348 of the alignment element 340 so as to allow the portions 344, 346 to connect. Alternatively, the guide line 342 may extend the entire length 348 of the alignment element 340 so as to completely separate the portions 344, 346. In certain other aspects, the guide line 342 may be intermittent, e.g. dashed.

Figure 7:
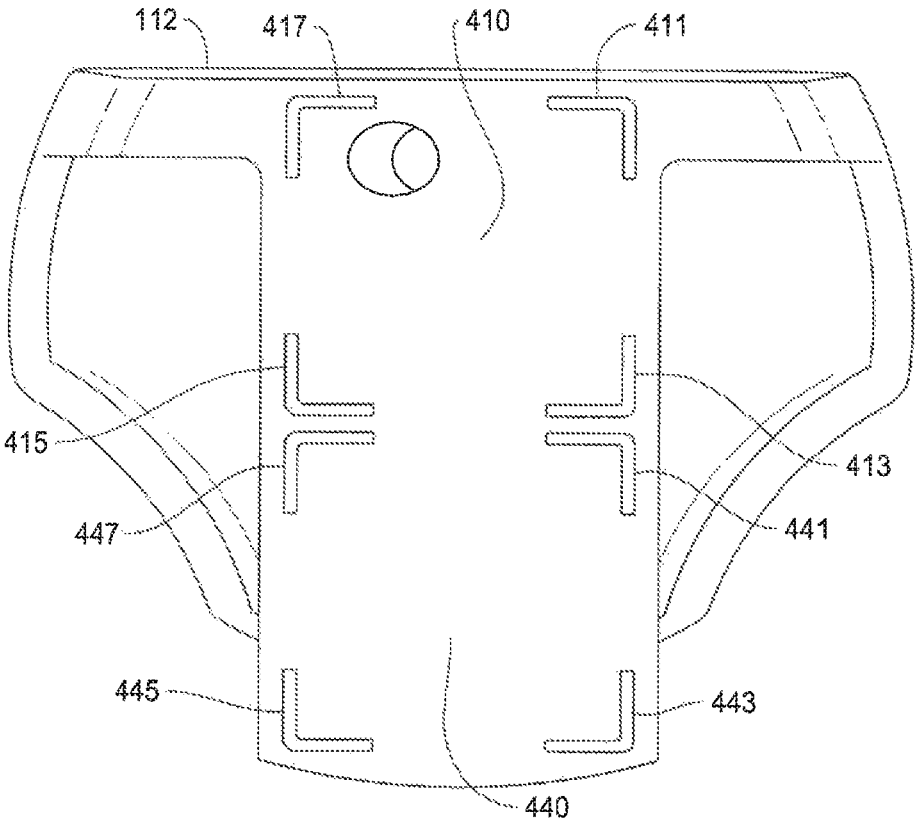
FIG. 7 shows a top plan view of an exemplary putter-type golf club head in accordance with one or more aspects of the present invention.

FIG. 7 shows another non-limiting example of the alignment elements that may be provided on the putter-type golf club head 100 according to the present invention. In this example, at least one of alignment elements 410 and 440 may be provided. Alignment elements 410 and 440 may substantially correspond to alignment elements 210 and 240, respectively, in overall size and in position on the top portion 142 of the central elongate member 140. The edges of the alignment elements 410 and 440 may substantially correspond to the edges 212, 216, 220, and 222 of the alignment element 210 and to the edges 242, 246, 250, and 252 of the alignment element 240, respectively, in length and in depth of the grooves forming the edges. However, the central portions of these edges may not be recessed into the top portion 142, thereby forming the alignment elements 410 and 440 as a plurality of corners 411, 413, 415, 417, 441, 443, 445, and 447. The lengths of the grooves forming these corners of the alignment elements 410 and 440 need not be particularly limited, for the grooves need only be of sufficient length to delineate to a golfer the orientation and dimensions of the alignment elements 410 and 440. In certain aspects, the portion of each corner parallel to the striking surface 112 may be equal in length to each corresponding corner portion perpendicular to the striking surface 112. Alternatively, the portion of each corner parallel to the striking surface 112 may be of different length (shorter or longer) than each corresponding corner portion perpendicular to the striking surface 112. In certain aspects, the grooves forming the plurality of corners 411, 413, 415, 417, 441, 443, 445, and 447 may all be of equal length. Alternatively, certain corners may be of different length than others. For example, corners 411, 417, 441, and 447 may be longer than corners 413, 415, 443, and 445.

Figure 8:
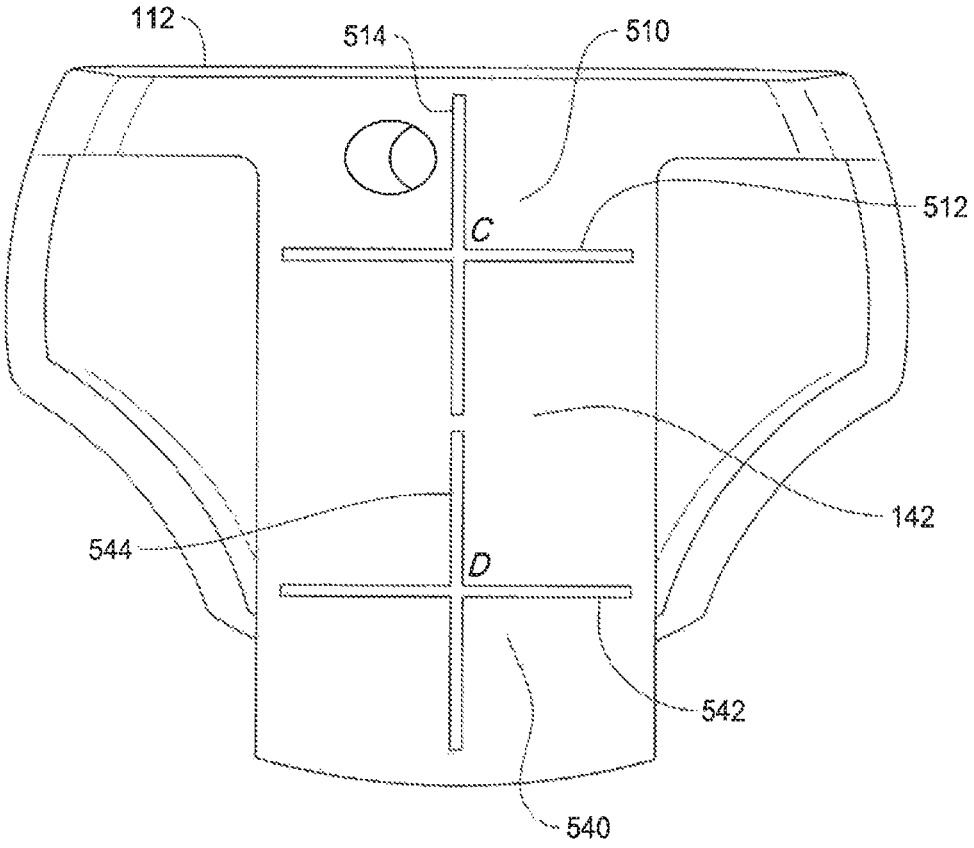
FIG. 8 shows a top plan view of an exemplary putter-type golf club head in accordance with one or more aspects of the present invention.

FIG. 8 shows another non-limiting example of the alignment elements that may be provided on the putter-type golf club head 100 according to the present invention. In this example, at least one of alignment elements 510 and 540 may be provided. Alignment elements 510 and 540 may be provided as "cross-hairs," respectively comprising edges 512, 514 and 542, 544. Edges 512, 514 and 542, 544 may be formed in a manner substantially similar to edges 212, 216, 220, 222, 242, 246, 250, and 252 of the alignment elements 210 and 240. Edges 512 and 542 may be substantially parallel to the striking surface 112, and they may be slightly less than, slightly more than, substantially equal to, or equal to the 1.62 in. diameter of a golf ball. Edges 514 and 544 may be perpendicular to the striking surface 112, and they may respectively intersect the centers of the edges 512 and 542. In certain aspects, edges 514 and 544 may also be slightly less than, slightly more than, substantially equal to, or equal to the 1.62 in. diameter of a golf ball. As seen in FIG. 8, the edges forming the alignment elements 510 and 540 may intersect at points C and D on the top surface 142, points C and D respectively corresponding to the centers of the alignment elements 210 and 240.

Figure 9:
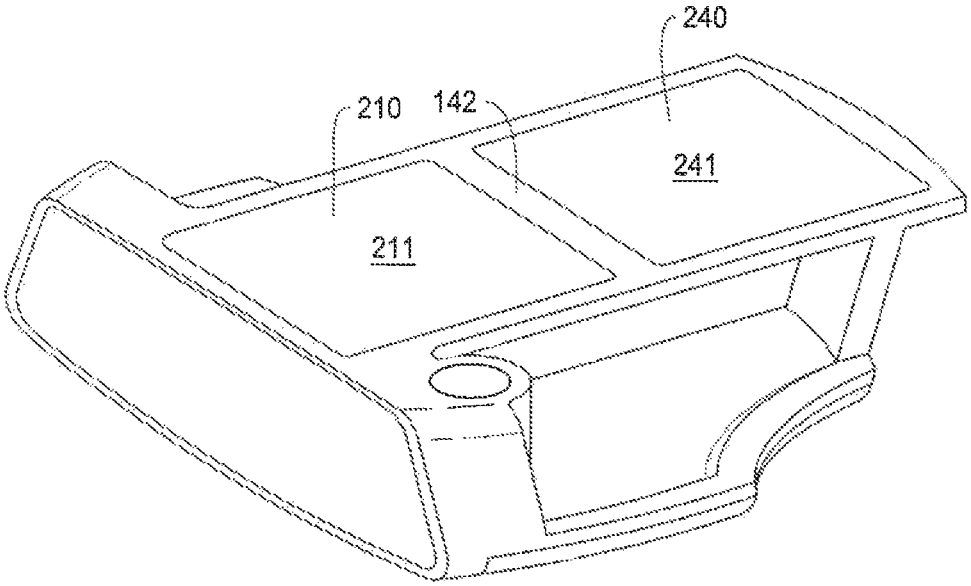
FIG. 9 shows a perspective view of an exemplary putter-type golf club head in accordance with one or more aspects of the present invention.

In the preceding examples, the alignment elements have all been formed by grooves projecting into the top surface 142 of the central elongate member 140. However, this need not be the case. For example, as illustrated in FIG. 9, at least one alignment element may be an insert provided in a corresponding opening in the top surface 142. FIG. 9 shows inserts 211 and 241 respectively forming alignment elements 210 and 240. Examples of materials suitable for fabricating the inserts may include polyurethane, silicone, Nylon, polypropylene (PP), polyethylene (PE), thermoplastic rubber (TPR), thermoplastic vulcanizate (TPV), thermoplastic polyurethane (TPU), thermoplastic elastomers (TPE), ionomers such as Surlyn®, and natural rubber. The inserts may be a different color than the body 102 of the club head 100, say white, through painting or doping of the insert with coloring agents, and the inserts may be bonded to the central elongate member 140 using, e.g., an epoxy-type adhesive. The thickness of the inserts is not particularly limited, but in certain aspects, the thickness of the inserts may be less than the thickness 162 of the top portion 142.

Figure 10:
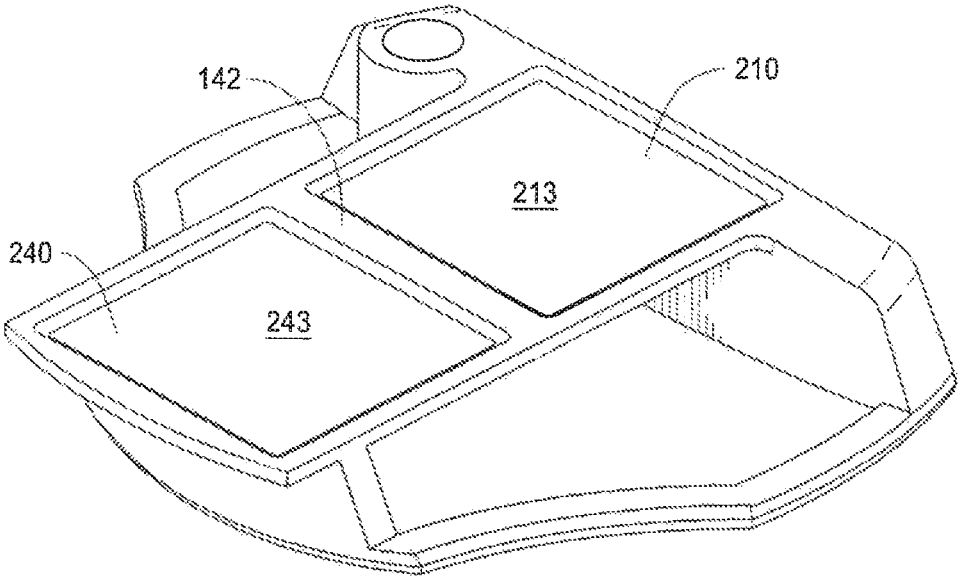
FIG. 10 shows a perspective view of an exemplary putter-type golf club head in accordance with one or more aspects of the present invention.

In another example, such as that illustrated in FIG. 10, at least one of the alignment elements may be recessed into the top portion 142 of the central elongate member 140 substantially over its entire planar area, more preferably over its entire planar area. FIG. 10 shows the edges of the alignment elements 210 and 240 not as portions of grooves, but as beveled edges projecting from the uppermost surface of the top portion 142 downward. Center, recessed portions 213 and 243 of the alignment elements 210 and 240 are lower (i.e. closer to the sole portion 120) than the uppermost surface of the top portion 142. In certain aspects, the beveled edges of the alignment elements 210 and 240 are a different color than the body 102 of the club head 100. In certain other aspects, the center, recessed portions 213 and 243 are a different color than the body 102 of the club head 100. In yet other aspects, both the beveled edges and the center portions 213 and 243 are a different color than the body 102.

Even further non-limiting examples are envisioned as being within the scope of the present invention. In the following examples, the structure of the golf club head is altered. Although the alignment elements 200 are specifically shown in these following examples, it is to be understood that the disclosed golf club heads may be provided with the alignment elements 310 and 340, 410 and 440, 510 and 540, and/or any other suitable alignment element.

As discussed previously, a significant amount of land area (and thus mass) is required for the top surface of the central elongate member to support the alignment elements 200. Therefore, much of the remaining structure of the following examples is dedicated toward resolving structural issues with a more limited mass budget. For example, although there is generally no expectation for a putter-type club head to have a particular primary resonant frequency, a sustained ringing (as opposed to an attenuated sound) at impact is generally disfavored. Thus, well-connected design elements are generally preferred over a cantilevered structure. Wall thickness is also generally reduced where possible, say in the striking surface wall to reduce overall mass.

Figure 11:
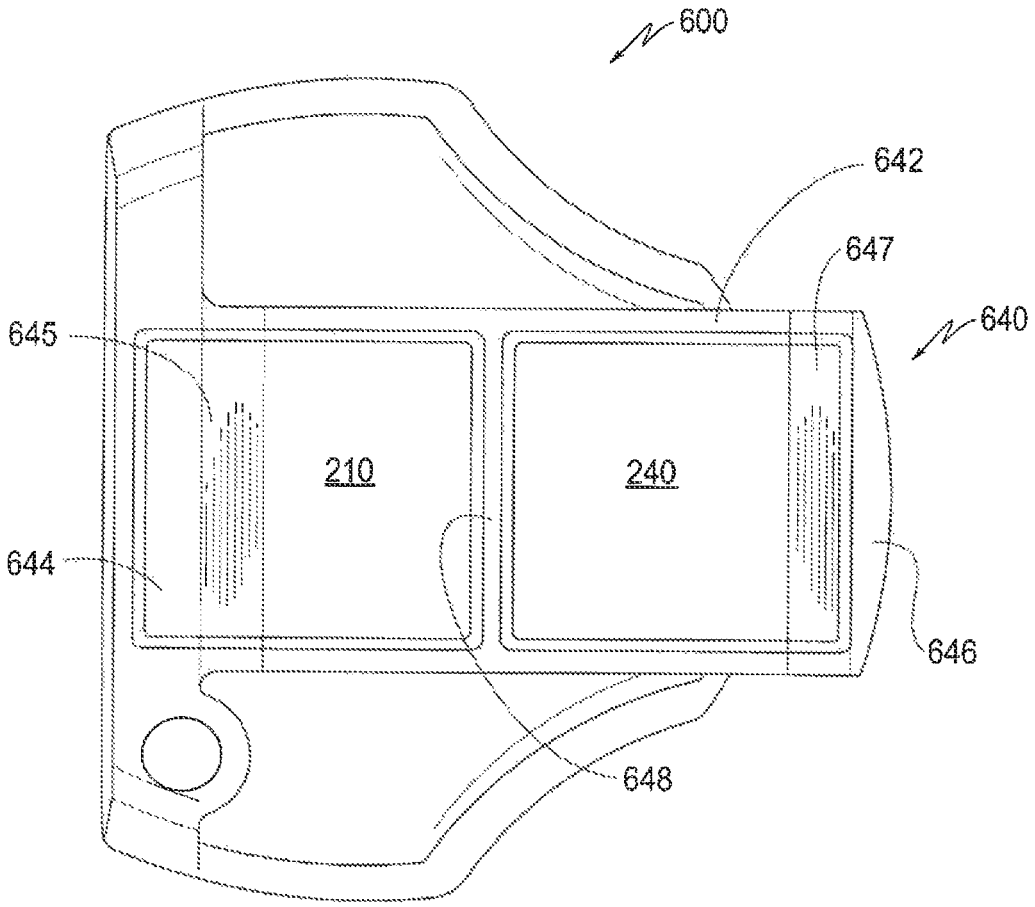
FIG. 11 shows a top plan view of an exemplary putter-type golf club head in accordance with one or more aspects of the present invention.
Figure 12:
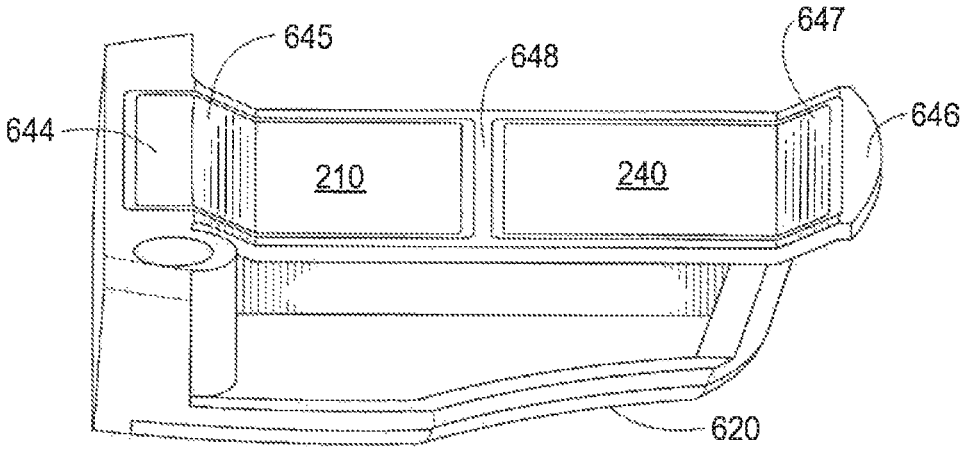
FIG. 12 shows a side perspective view of the putter-type golf club head of FIG. 11.

FIGS. 11 and 12 show a golf club head 600. In the club head 600, the top surface 642 of the central elongate member 640 may not be entirely planar. Rather, the top surface 642 may comprise a front portion 644, a rear portion 646, and a central portion 648 that is recessed from the portions 644, 646 toward the sole portion 620. In certain aspects, surface portions 644, 646, and 648 may each be planar and parallel to each other. Beveled connecting portions 645 and 647 may respectively connect the portions 644, 648 and 646, 648. As shown in FIG. 11, when viewed from directly above by a golfer in the reference position, with eyes generally above the club head 600, the alignment elements 210 and 240 appear as squares. However, when the golfer views the club head in the same position, but the club head 600 is angularly offset from the reference position about the x-axis (see FIG. 3), the alignment features 210 and 240 do not form geometric squares having straight lines. Rather, when the club head 600 is offset, the edges of the alignment features 210 and 240 appear as jagged lines to the golfer instead of straight lines. This feature further assists the golfer in quickly aligning the club head 600 in its proper position with minimal mental exertion.

Figure 13:
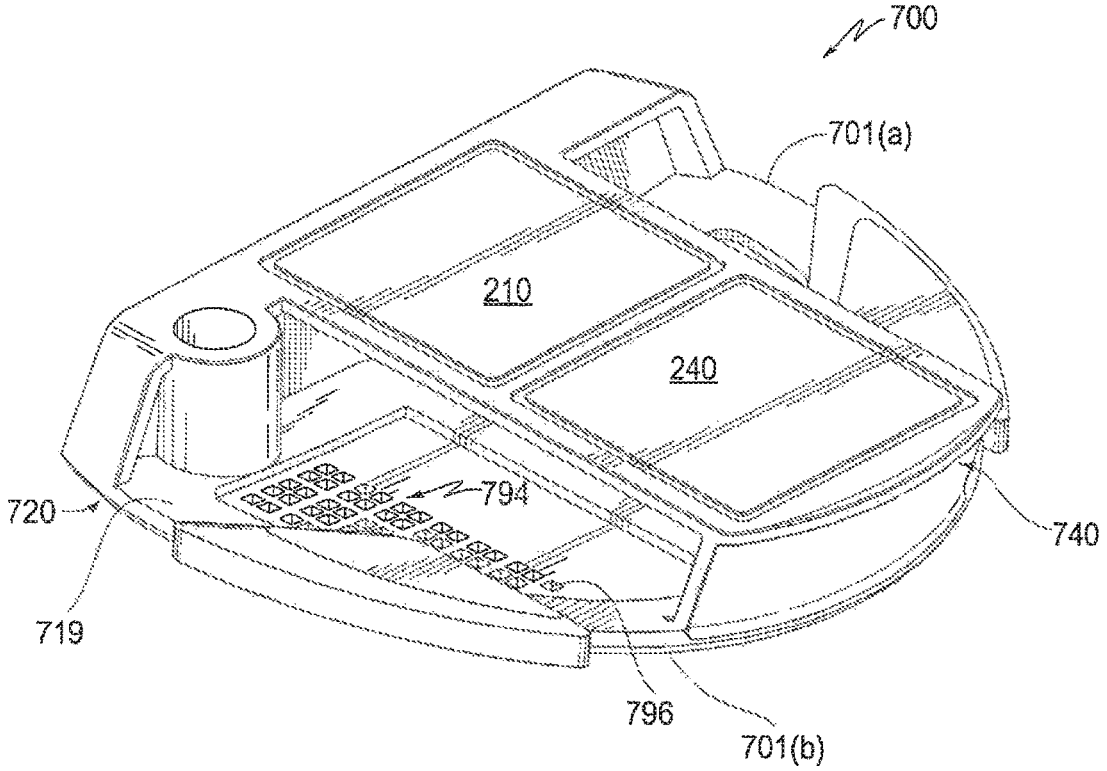
FIG. 13 shows a perspective view of an exemplary putter-type golf club head in accordance with one or more aspects of the present invention.
Figure 14:
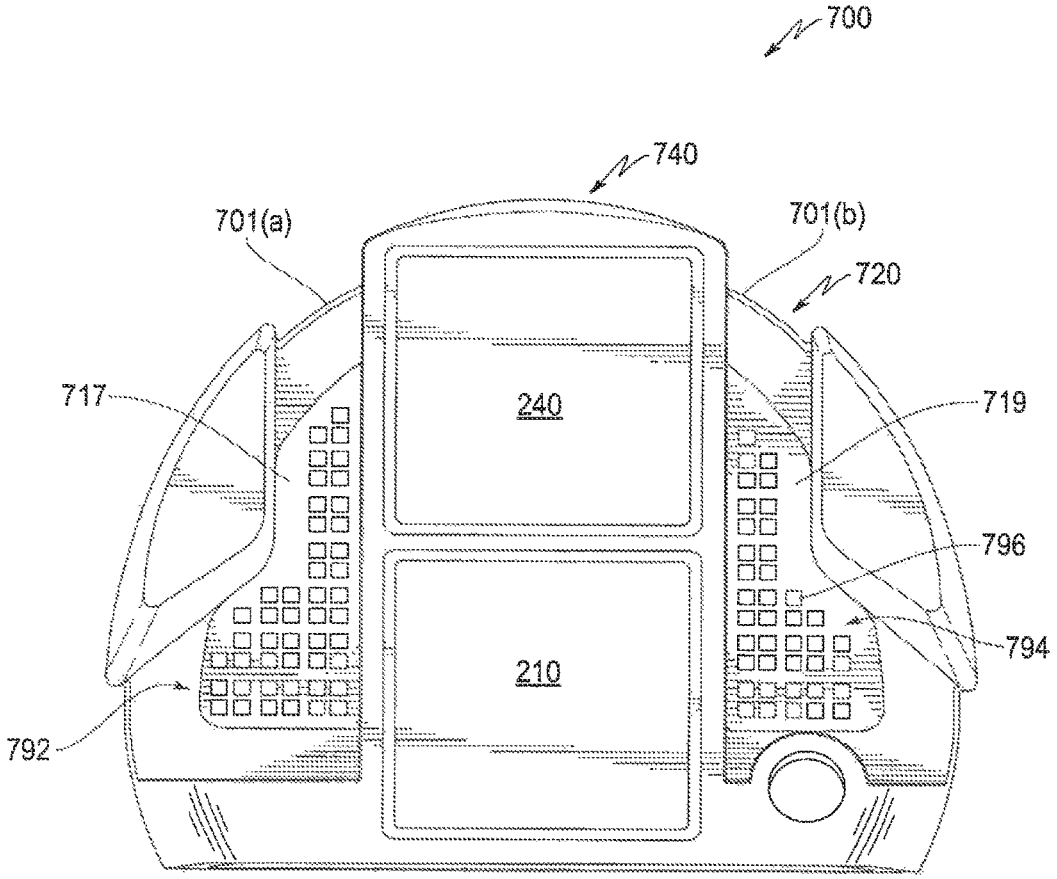
FIG. 14 shows a top plan view of the putter-type golf club head of FIG. 13.
Figure 15:
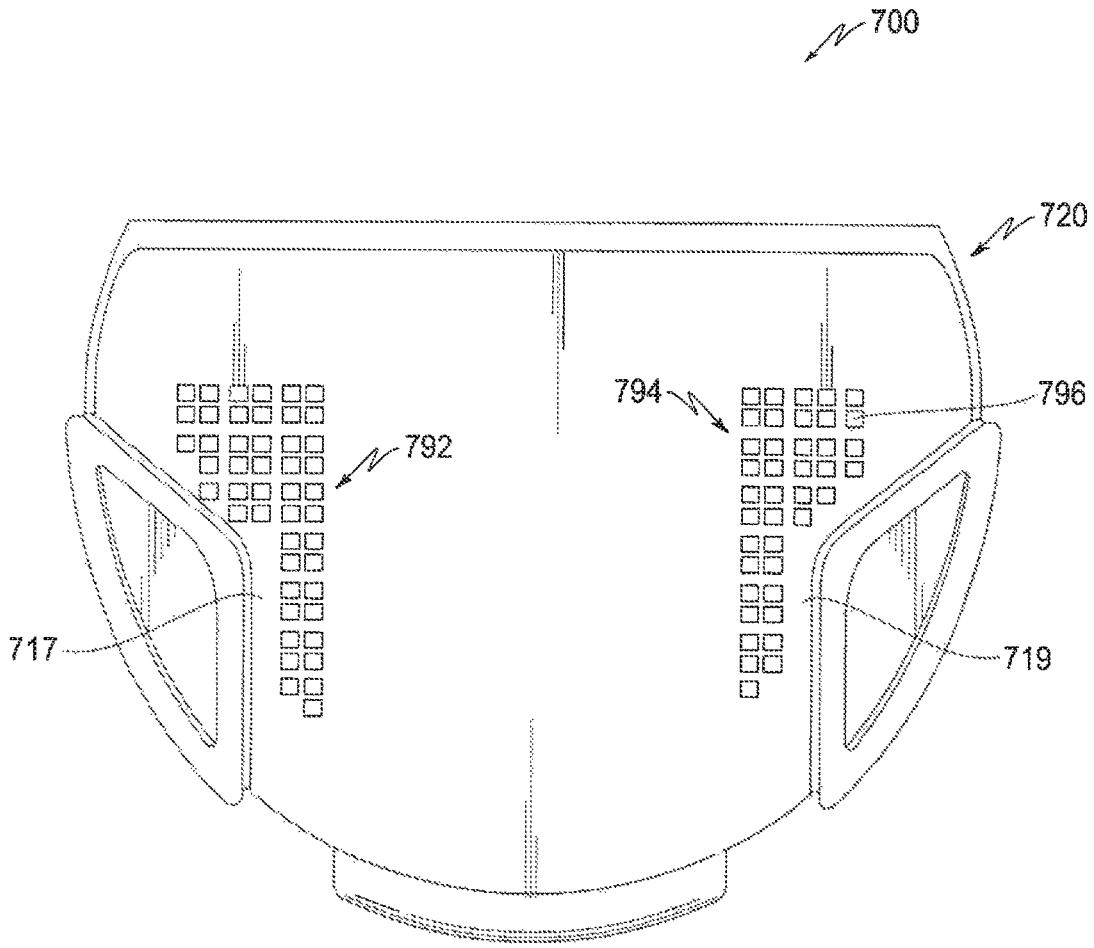
FIG. 15 shows a bottom plan view of the putter-type golf club head of FIG. 13.

FIGS. 13-15 show another non-limiting example 700 of the golf club head according to the present invention. The club head 700 includes mesh cutout regions 792, 794 in the sole portion 720. These mesh cutout regions 792, 794 allow for further mass reduction of the club head 700 in unsuitable regions while simultaneously maintaining structural integrity of the club head 700.

The mesh cutout regions 792, 794 may comprise a plurality of apertures 796 projecting through the sole portion 720. In some embodiments such apertures 796 may extend only partially through the sole portion 720. However, the apertures 796 preferably extend entirely through the sole portion 720. These apertures 720 may be square-shaped in top plan view, which mirrors the shape of the square alignment elements 210, 240 on the central elongate member 740. However, the plurality of apertures 796 may have other shapes. For example, the apertures 796 may be circular, triangular, pentagonal, hexagonal, octagonal, slot-shaped, or any other known geometric shape. As shown in FIGS. 13-15, the apertures 796 all have the same shape, but it is envisioned that some apertures 796 may have shapes different than other apertures 796. The apertures 796 may also be grouped within the mesh cutout regions 792, 794. For example, as shown in FIGS. 13-15, the apertures 796 may be arranged in groups of four. The spacing between apertures 796 comprising each group of four may be less than the spacing between apertures 796 of adjacent groups of four. In alternative embodiments, the apertures may form a staggered pattern.

The mesh cutout regions 792, 794 may also be spaced from the outer periphery of the sole portion 720. This spacing may thus create bands of material 717, 719 separating the mesh cutout regions 792, 794 from the toe arm 701(*a*) and the heel arm 701(*b*) of the club head 700. The mesh cutout regions 792, 794 may also be spaced from the central elongate member 740. That is, as shown in FIG. 14, the mesh cutout regions 792, 794 may not be overlapped by the central elongate member 740 in top plan view.

Figure 16:
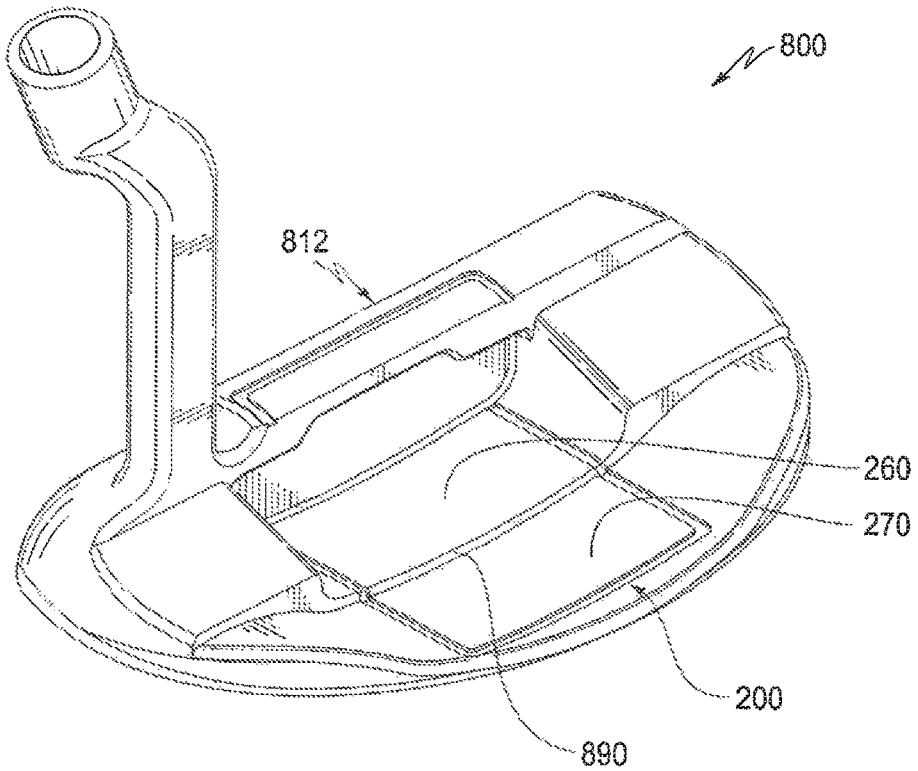
FIG. 16 shows a perspective view of an exemplary putter-type golf club head in accordance with one or more aspects of the present invention.
Figure 17:
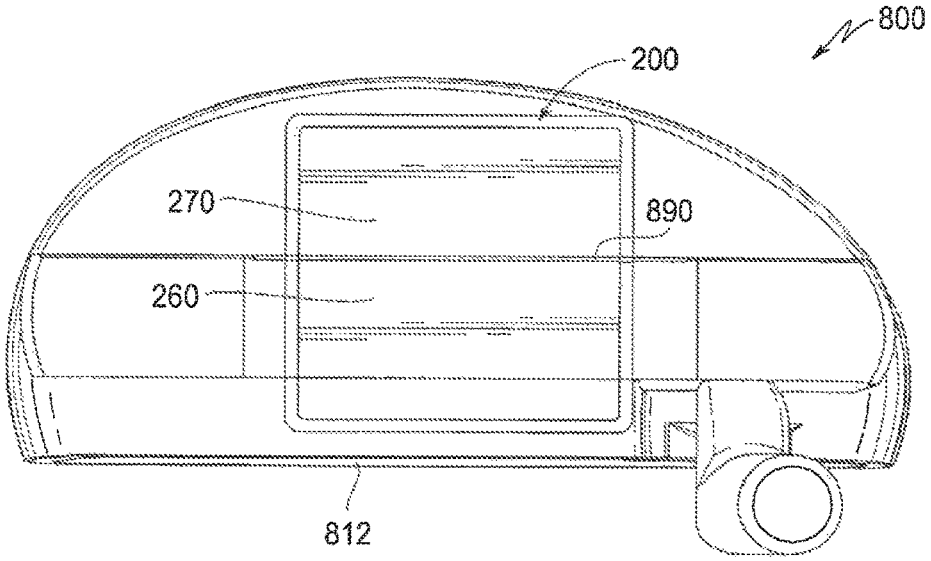
FIG. 17 shows a top plan view of the putter-type golf club head of FIG. 16.

FIGS. 16 and 17 show another non-limiting example 800 of the golf club head according to the present invention. In this example, a single square alignment element 200 is provided on the club head 800. The club head 800 may also include a step 890 that extends generally vertically and through the single square alignment element 200. The step 890 may divide the square alignment element 200 into split portions 260 and 270 that are vertically offset from one another. As shown in FIG. 16, the portion 270 is lower (i.e., closer to the sole portion) than the portion 260. In certain aspects, the step 890 may bisect the single square alignment element 200 so that the portions 260, 270 have equal areas and/or equal depths. However, it is within the scope of the present invention that the step 890 may not bisect the single square alignment element 200. Rather, the portion 260 may have a smaller area than the portion 270, or the portion 260 may have a larger area than the portion 270. By virtue of the step 890, a golfer is better able to ensure that the club head 800 is squared relative to a golf ball. If the club head 800 is not squared, the edges of the square alignment element 200 appear as jagged lines to the golfer instead of as straight lines. Furthermore, as shown in FIG. 17, when the club head 800 is properly squared, the square alignment element 200 maintains its shape in top plan view, thereby ensuring that the above-described benefits of a square alignment feature are maintained.

Figure 18:
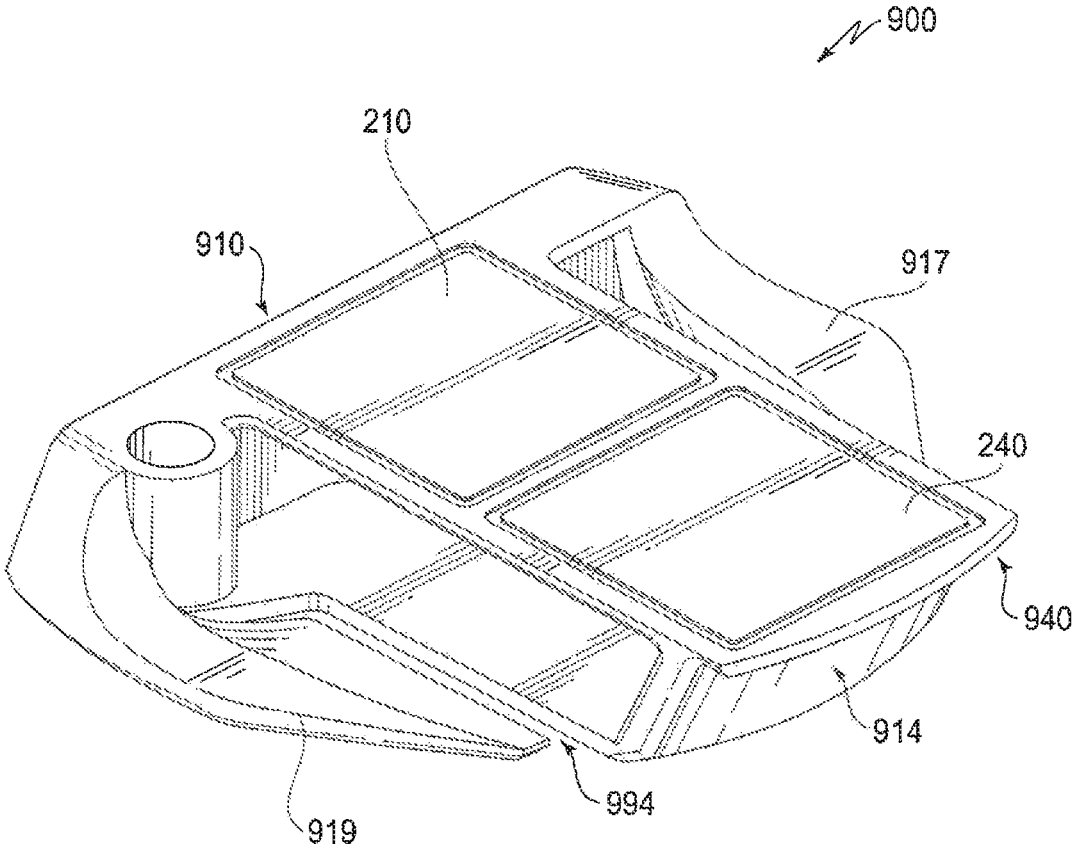
FIG. 18 shows a perspective view of an exemplary putter-type golf club head in accordance with one or more aspects of the present invention.
Figure 19:
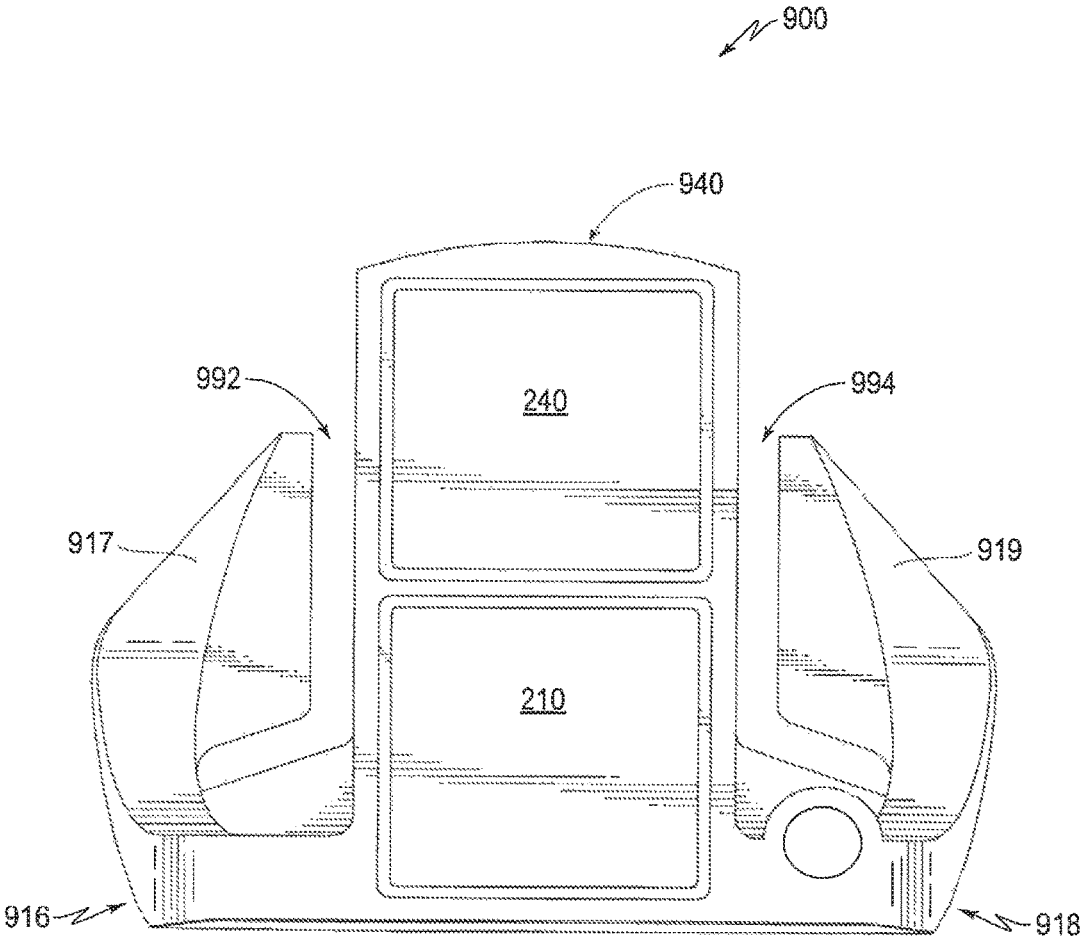
FIG. 19 shows a top plan view of the putter-type golf club head of FIG. 18.
Figure 20:
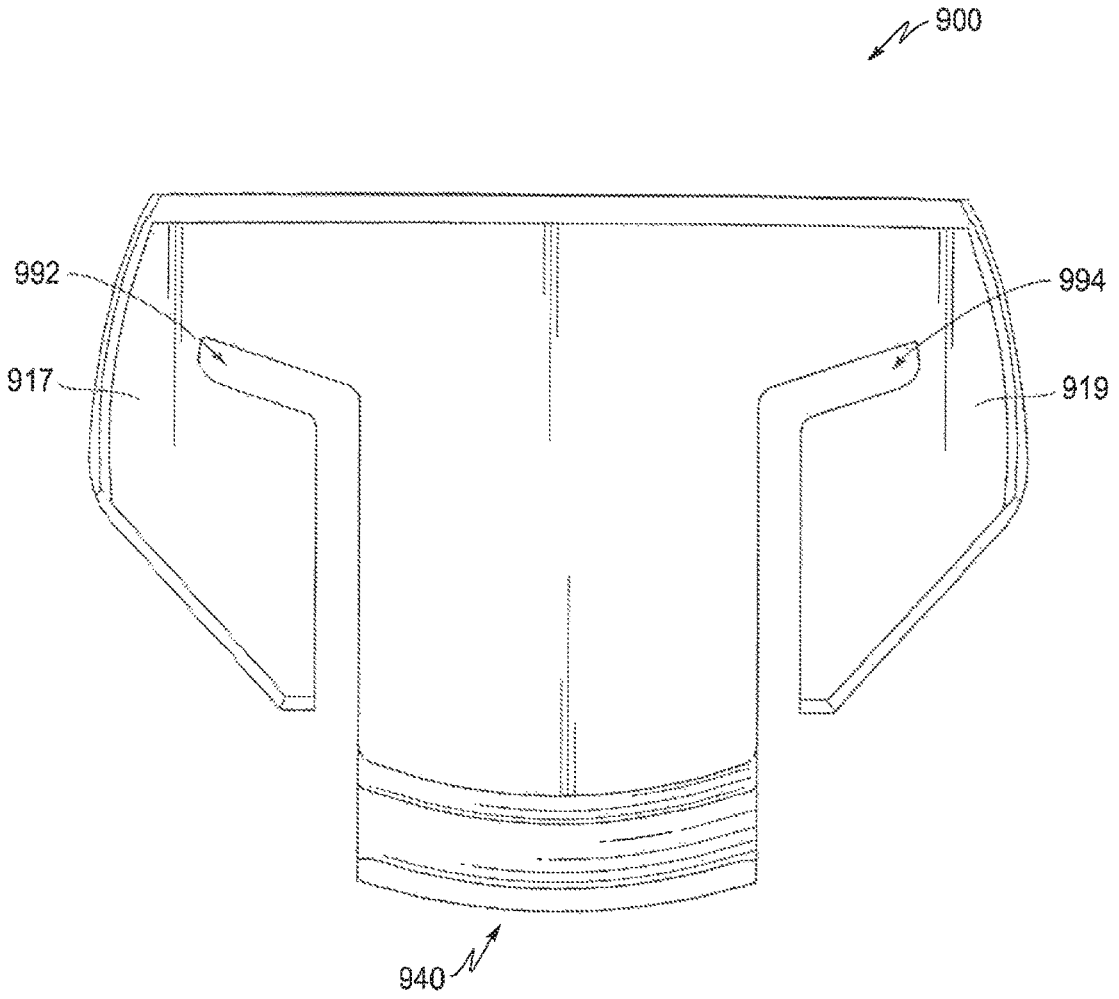
FIG. 20 shows a bottom plan view of the putter-type golf club head of FIG. 18.

FIGS. 18-20 show another non-limiting example 900 of the golf club head according to the present invention. In this example, cantilevered toe and heel arms 917, 919 are formed in the club head 900. The cantilevered arms 917, 919 originate from the front portion 910 of the club head 900 and project rearward toward the rear portion 914. Gaps 992, 994 may separate the cantilevered arms 917, 919 from the central elongate member 940. As effectively shown in FIGS. 19 and 20, although the gaps 992, 994 may be straight, they need not be so. Rather, the gaps 992, 994 may bend toward the toe portion 916 and the heel portion 918, respectively. As best shown in FIG. 18, the cantilevered arms 917, 919 may be tapered. In certain aspects, the arms 917, 919 may taper from the front portion 910 toward the rear portion 914. Thus, the arms 917, 919 may become thicker closer to the front portion 910. This configuration including such arms 917, 919 may increase the moment of inertia of the club, thus providing greater forgiveness on off-centered golf shots. Such configuration may further provide, by virtue of gaps 992, 994, a visual indication to the golfer of proper alignment. By tapering the arms 917, 919 in the front to rear direction, sustained vibration on impact may be reduced improving feel and/or acoustic characteristics.

Figure 21:
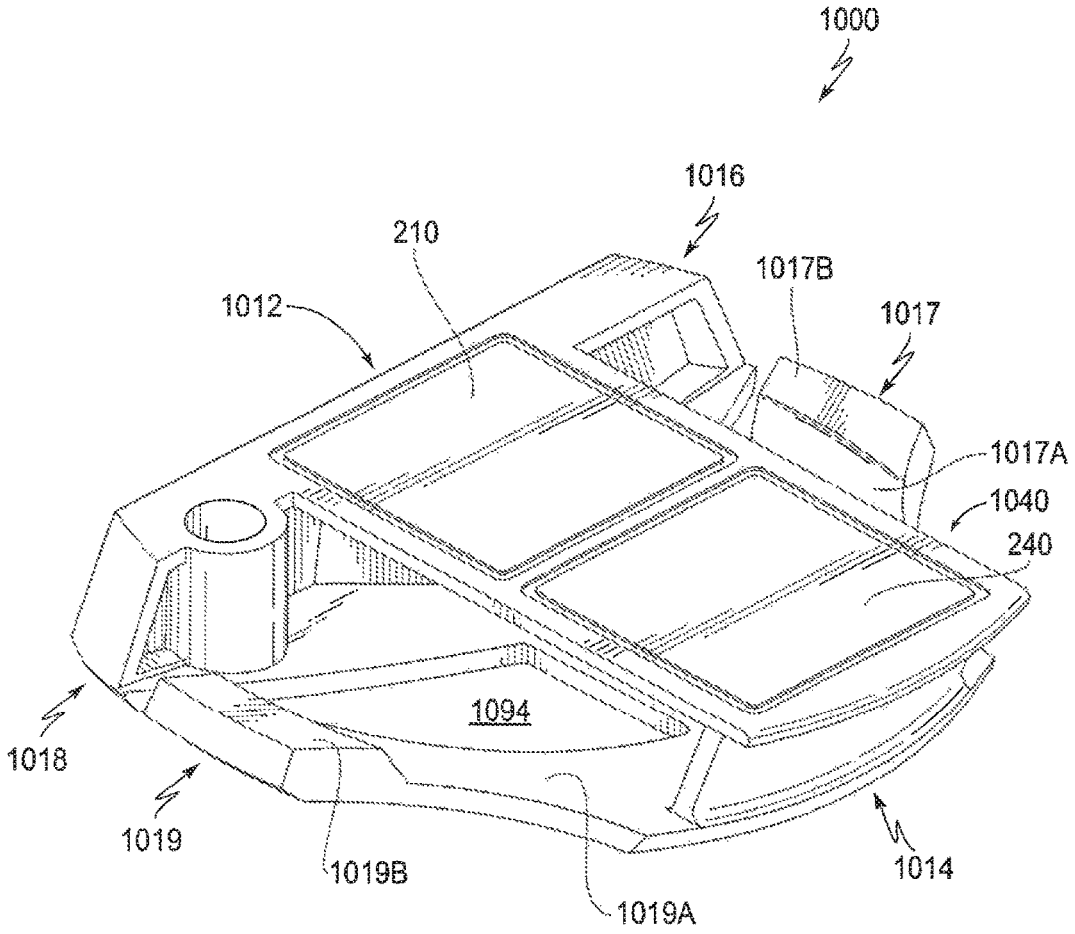
FIG. 21 shows a perspective view of an exemplary putter-type golf club head in accordance with one or more aspects of the present invention.
Figure 22:
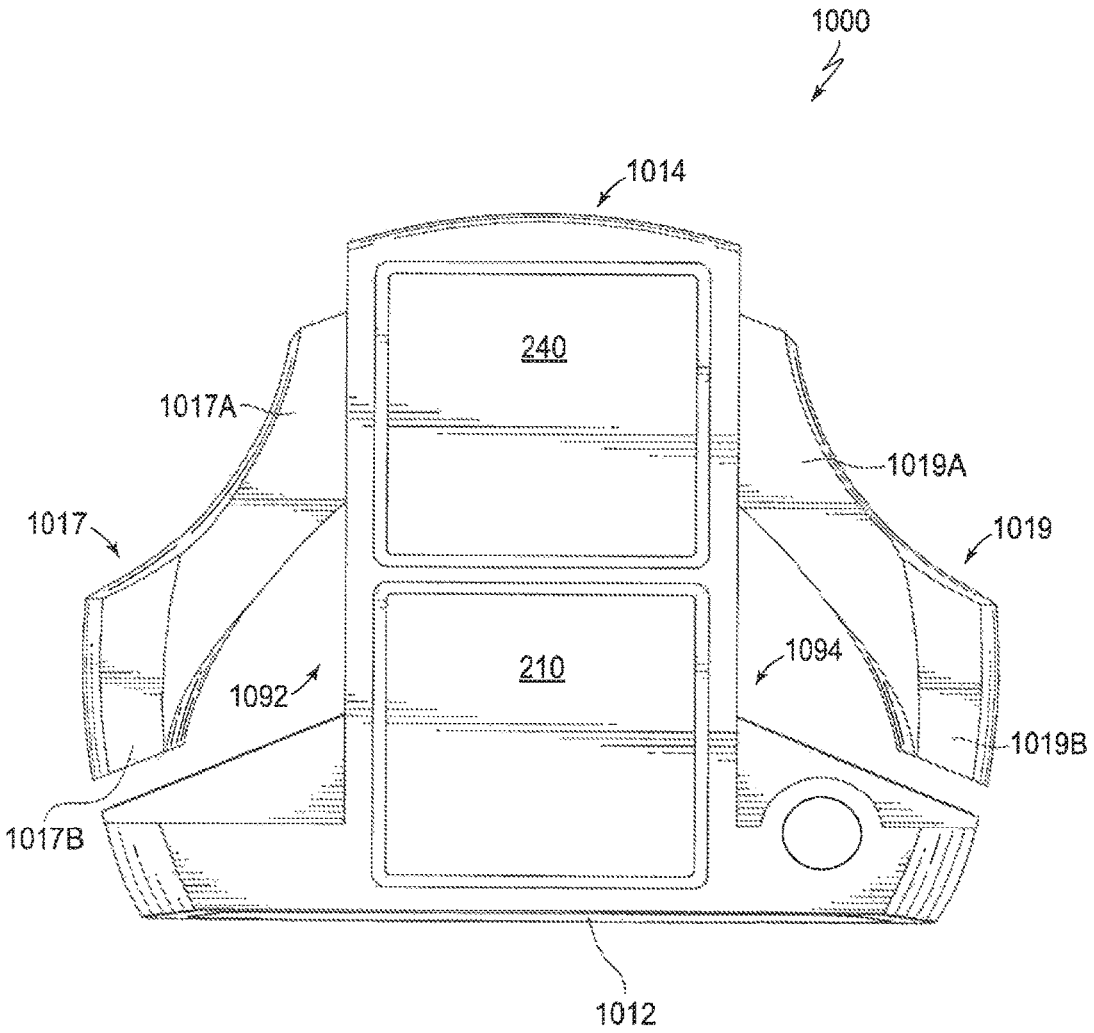
FIG. 22 shows a top plan view of the putter-type golf club head of FIG. 21.
Figure 23:
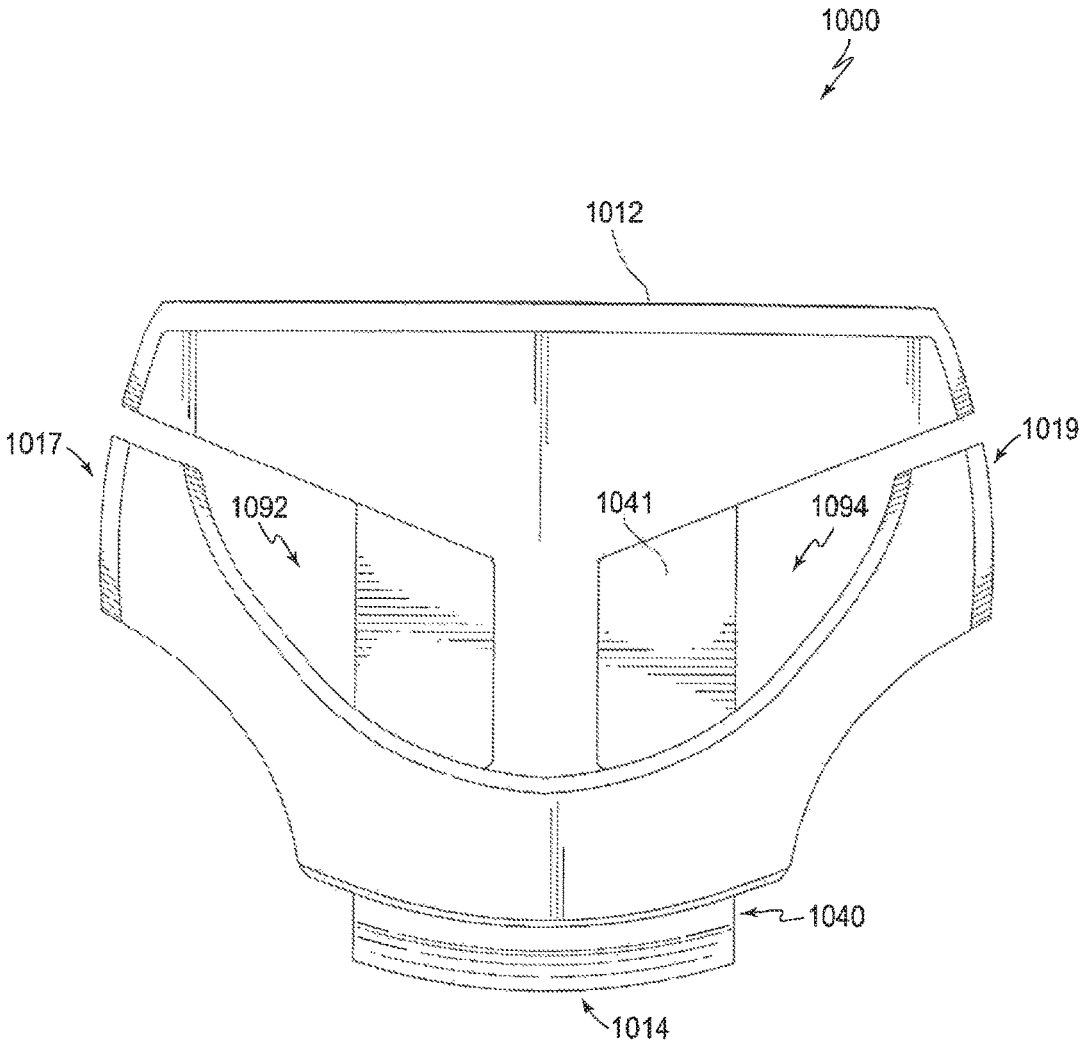
FIG. 23 shows a bottom plan view of the putter-type golf club head of FIG. 21.

FIGS. 21-23 show another non-limiting example 1000 of the golf club head according to the present disclosure. As with the club head 900, the club head 1000 may include cantilevered toe and heel arms 1017, 1019. However, whereas the arms 917, 919 of the club head 900 project from the front portion 910 toward the rear portion 914, the arms 1017, 1019 may project from the rear portion 1014 toward the front portion 1010. Thus, the arms 1017, 1019 may join the central elongate member 1040 proximate the rear portion 1014. The arms 1017, 1019 may respectively include inner, plate-like portions 1017*a*, 1019*a* and outer, projecting portions 1017*b*, 1019*b*. Thus, the arms 1017, 1019 may be thicker at locations closer to the toe portion 1016 and the heel portion 1018 then at locations closer to the central elongate member 1040. Gaps 1092, 1094 may be formed in the club head 1000 to space the arms 1017, 1019 from the central elongate member 1040 and the striking surface 1012. As best shown in FIG. 23, the central elongate member 1040 may include an overhang portion 1041, and the gaps 1092, 1094 may extend under this overhang portion 1041.

The golf club head 1000 according to this example possesses certain advantages and disadvantages. By spacing the arms 1017, 1019 from the striking surface 1012, the center of gravity of the club head 1000 is positioned further rearward. Additionally, the moment of inertia $I_{ZZ}$ of the club head 1000 about an axis through the center of gravity of the club head 1000 and extending vertically is increased. The spacing of the arms 1017, 1019 from the striking surface 1012 may also prevent undesirable direct transmission of vibration to arms 1017, 1019 upon striking a golf ball with the club head 1000.

Figure 24:
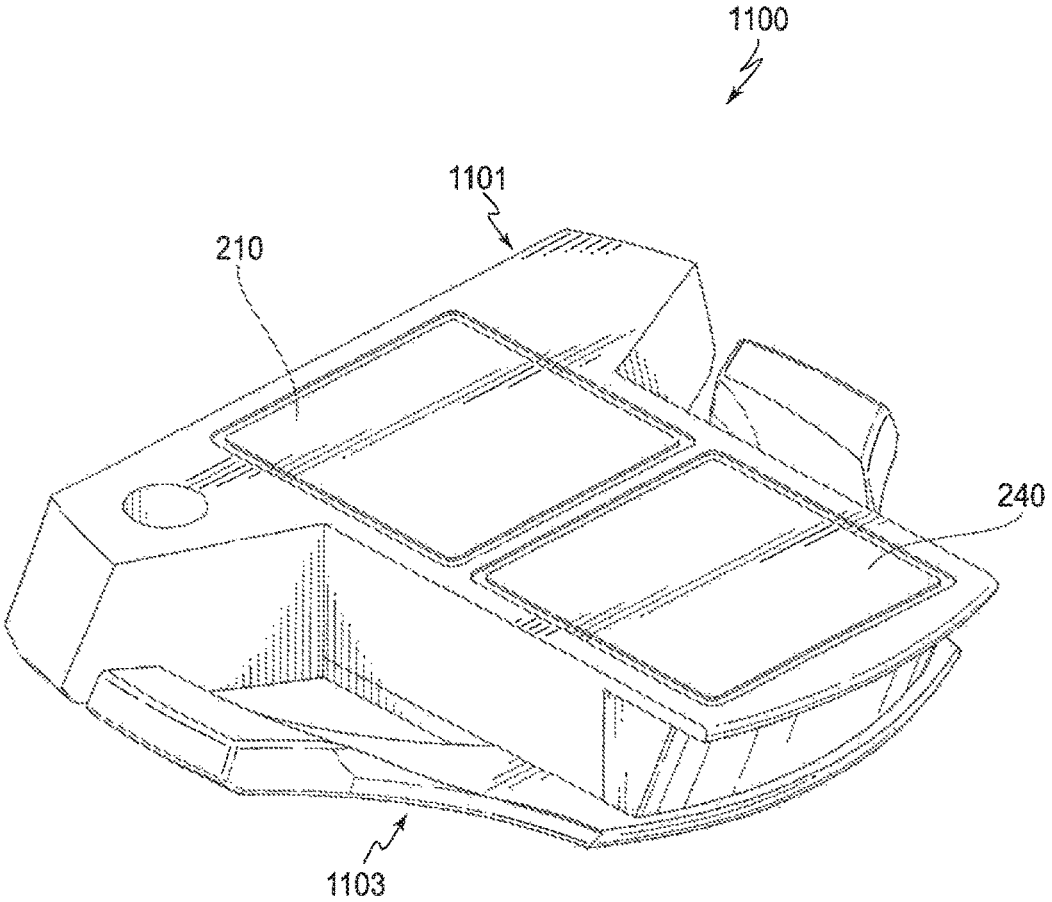
FIG. 24 shows a perspective view of an exemplary putter-type golf club head in accordance with one or more aspects of the present invention.
Figure 25:
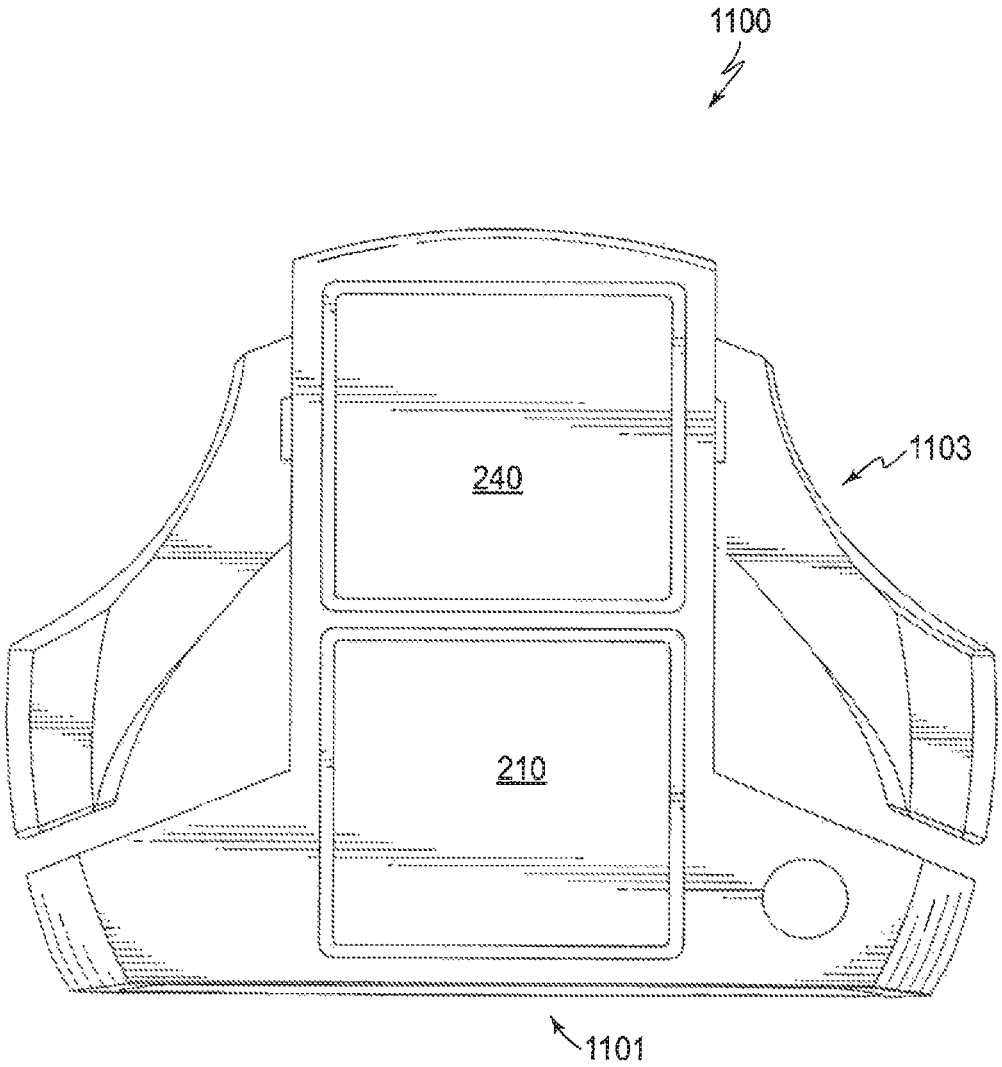
FIG. 25 shows a top plan view of the putter-type golf club head of FIG. 24.
Figure 26:
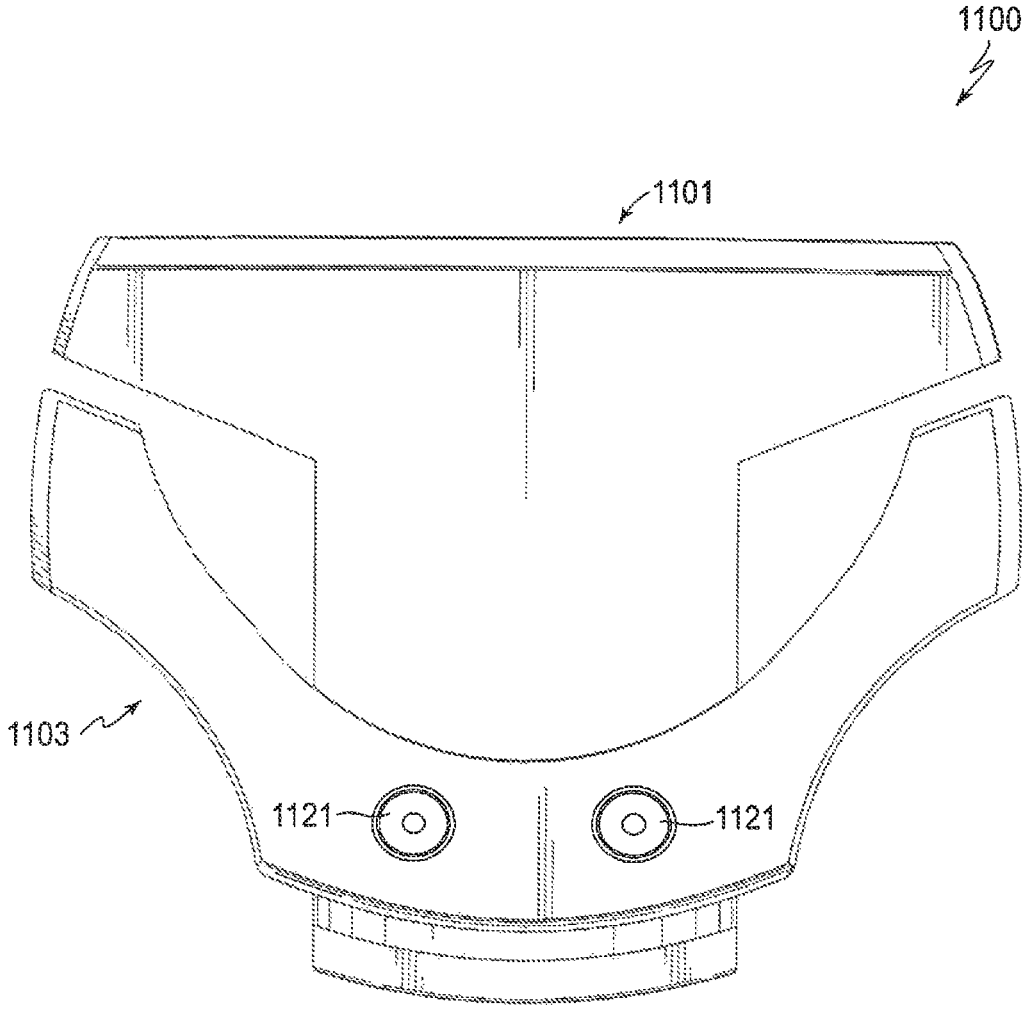
FIG. 26 shows a bottom plan view of the putter-type golf club head of FIG. 24.
Figure 27:
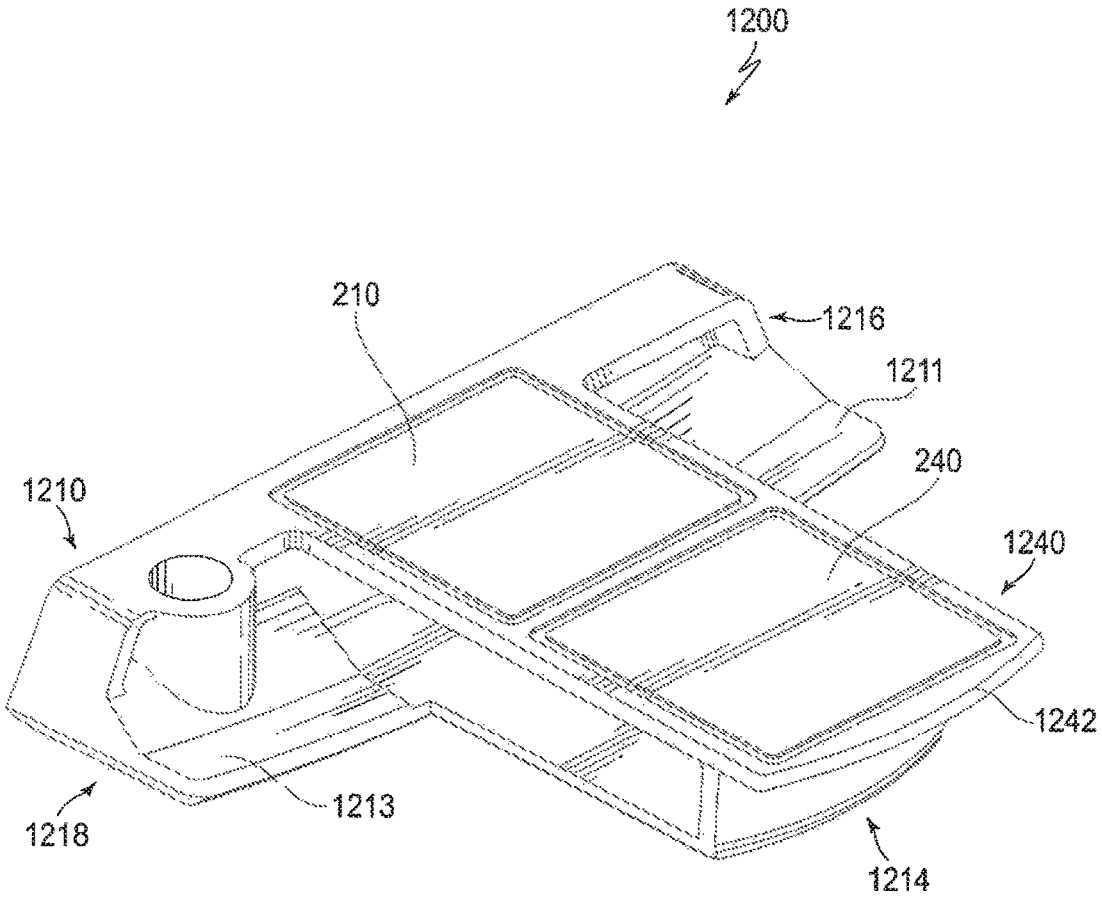
FIG. 27 shows a perspective view of an exemplary putter-type golf club head in accordance with one or more aspects of the present invention.

Shown in FIGS. 24-26 is another non-limiting example 1100 of the golf club head according to the present disclosure. The club head 1100 of this example shares structural similarities to the club head 1000. However, the club head 1100 may be composed of 2 distinct portions 1101, 1103. Although the club head 1100 is shown as being composed of 2 distinct portions, it is to be understood that the club head 1100 may be composed of more portions. For example, the club head 1100 may be composed of three distinct portions, four distinct portions, etc.

The sole portion 1103 may be secured to the top portion 1101 by securing members 1121. As shown in FIG. 26, two securing members 1121 may be provided, but other numbers of securing members are envisioned as being within the scope of the invention. For example, one, three, four, etc. securing members 1121 may be provided. In some embodiments, the portions 1101, 1103 may be adhered by chemical means, e.g. adhesive material, welding, brazing, or other known forms of bonding. Alternatively, or in addition, the portions 1101, 1103 may be adhered mechanically, e.g. by interlocking components such as tongue and groove elements, interference fit, etc. Alternatively, or in addition, the portions 1101, 1103 may be coupled by way of mechanical fasteners such as magnetic elements, clamps, bolts, or pins. In FIG. 26, the securing members 1121 are shown as being threaded members (e.g., screws) that project through the sole portion 1103 and into the top portion 1101. Although FIG. 26 shows threaded members, the securing members 1121 may be any apparatus sufficient to secure the sole portion 1103 to the top portion 1101.

In certain aspects, the top portion 1101 and the sole portion 1103 may be made of stainless steel. In certain other aspects, preferably, the sole portion 1103 may have a greater density than the top portion 1101, and the top portion 1101 may thus be made from a material different than the sole portion 1103. For example, the top portion 1101 may be aluminum. In yet other aspects, the top portion 1101 may have a greater density than the sole portion 1103. Resilient material may also be sandwiched between the top portion 1101 and the sole portion 1103. For example, a polymeric gasket, O-ring, washer may be interposed between the portions 1101, 1103. Such material may comprise a rubber or other cross-linked polymer, thermoplastic urethane, polyamide (e.g. Nylon®), PBAX®, open- or close-cell foam, or other known material. This resilient material may compress to prevent loosening of the securing members 1121 resulting from vibrations of the club head 1100 upon coming into contact with a golf ball. The resilient material may also collaterally serve as a vibration damper, thereby increasing comfort to the golfer.

In the club head 1100, the sole portion 1103 is preferably sufficiently thick to provide for countersunk bores for the securing members 1121. This additional thickness requirement may result in the sole portion 1103 not possessing a thin wall construction, thereby potentially increasing the mass of the sole portion 1103. This additional mass consideration places yet further pressure on reducing mass in other regions of the club head 1100. Nonetheless, forming the sole portion 1103 separately from the top portion 1101 permits selecting specific materials for each portion 1101, 1103 that are advantageous provided their specific locations. For example, forming the sole portion 1103 of a higher density material than of the top portion 1101 may result in reducing the height of the center of gravity of the club head thus improving ball trajectory on impact. Alternatively, forming the top portion 1101 of a material having a higher density than that of the sole portion 1103 may permit greater ball spin on impact, which effect some golfers may consider particularly suitable. Alternatively, or in addition, the sole portion 1103 may selectively be formed of a more durable (e.g. a harder or more impact-resistant) material than of the top portion 1101. This feature may be advantageous in that the sole portion 1103 is likely to experience greater abrasion during typical use, e.g. via interaction with the ground. The embodiment of FIGS. 24-26 also enable interchangeability of either a sole portion 1103 or top portion 1101 with other sole portions or top portions having like attachment features. For example, either the top portion 1101 or the sole portion 1103, or both, may be offered in a kit as one of plural respective top portions, sole portion 1103, or both. This may permit golfers to customize their putter to the individual tastes.

FIGS. 27-32 show another non-limiting example 1200 of the golf club head according to the present disclosure. In this example, the club head 1200 may generally comprise a blade-like front member 1210 extending from the toe portion 1216 toward the heel portion 1218. A central elongate member 1240 may extend rearwardly from the front member 1210 toward the rear portion 1214. Upon the top portion 1242 of the central elongate member 1240, alignment elements 210, 240 may be provided.

Figure 28:
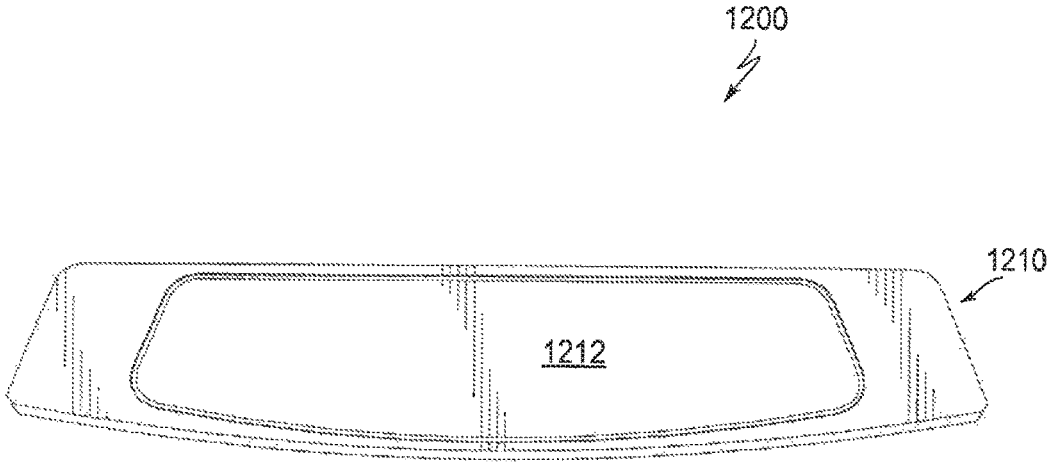
FIG. 28 shows a front view of the putter-type golf club head of FIG. 27.
Figure 29:
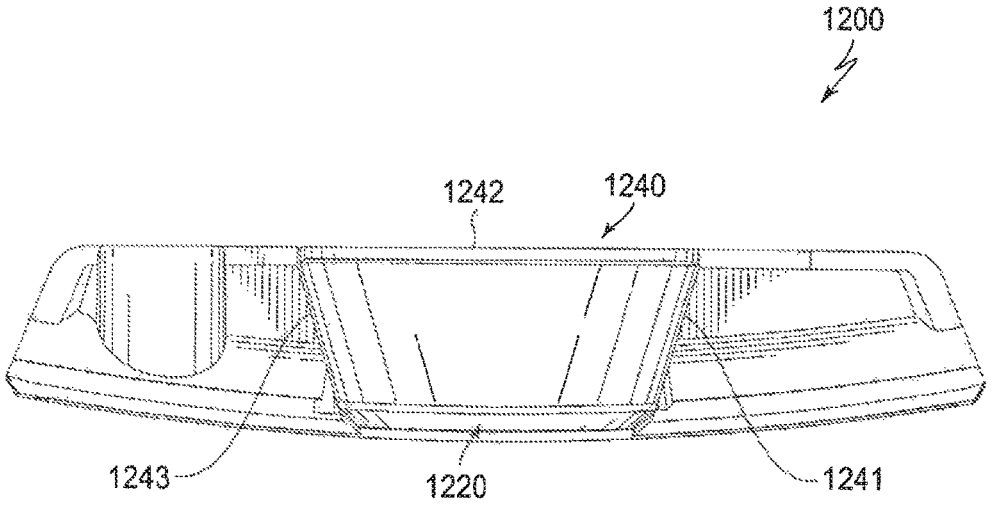
FIG. 29 shows a rear view of the putter-type golf club head of FIG. 27.

As shown in FIG. 28, the front member 1210 may comprise a striking wall including a striking surface 1212 for contacting a golf ball. As shown in FIG. 29, the central elongate member 1240 may comprise sidewalls 1241 and 1243, respectively provided toward the toe portion 1216 and the heel portion 1218. The sidewalls 1241, 1243 may be tapered inward from the top surface of 1242 of the central elongate member 1240 toward the sole portion 1220 of the club head 1200. This tapering of the central elongate member 1240 via the sidewalls 1241, 1243 prevents a golfer from seeing the sidewalls 1241, 1243 from a typical focal point assumed during a shot, thereby likely reducing the golfer's distraction. Preferably, the sidewalls 1241, 1243 are tapered at an angle no less than 5° measured relative to the vertical, and more preferably between 10° and 45° degrees.

Figure 30:
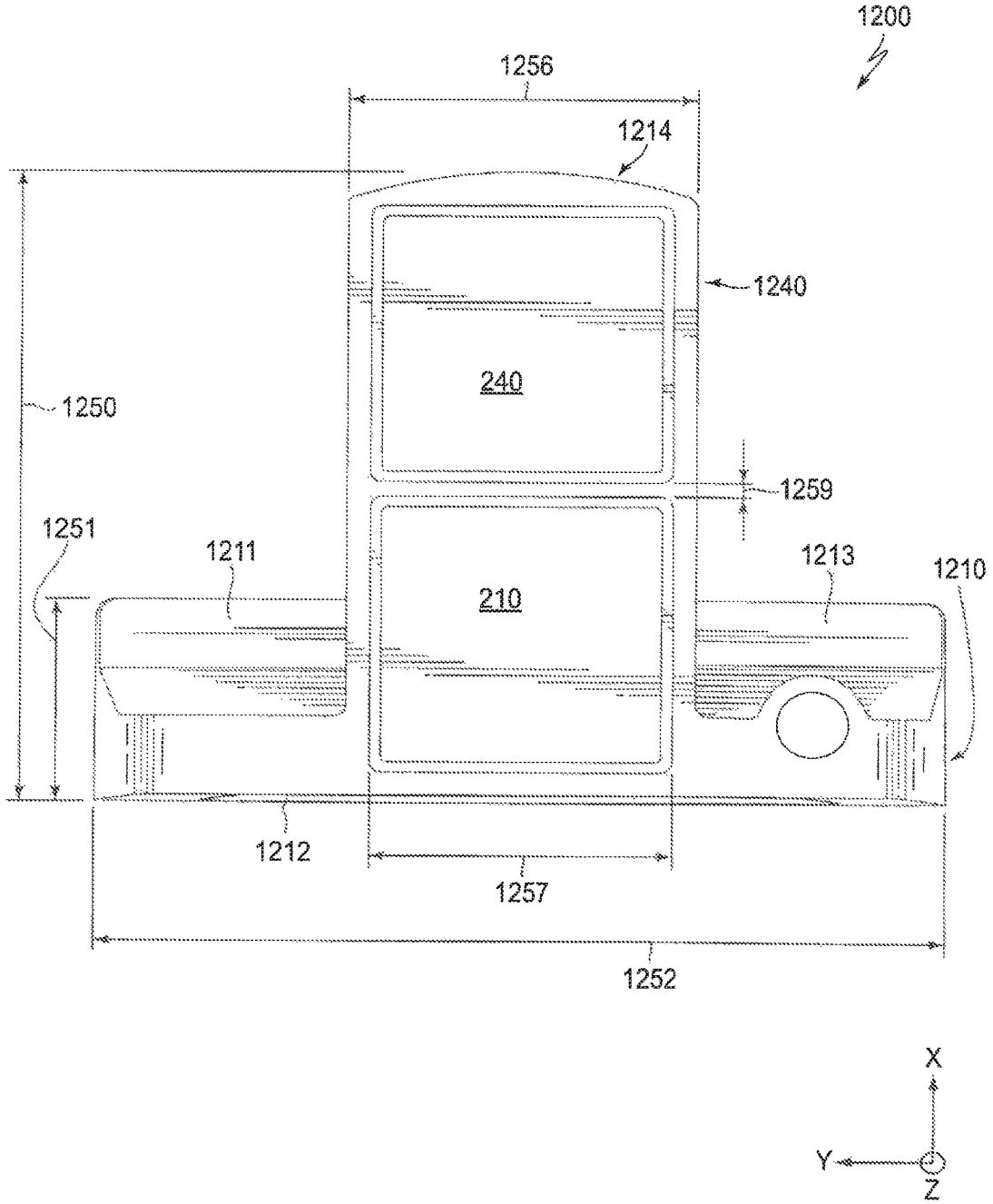
FIG. 30 shows a top plan view of the putter-type golf club head of FIG. 27.
Figure 31:
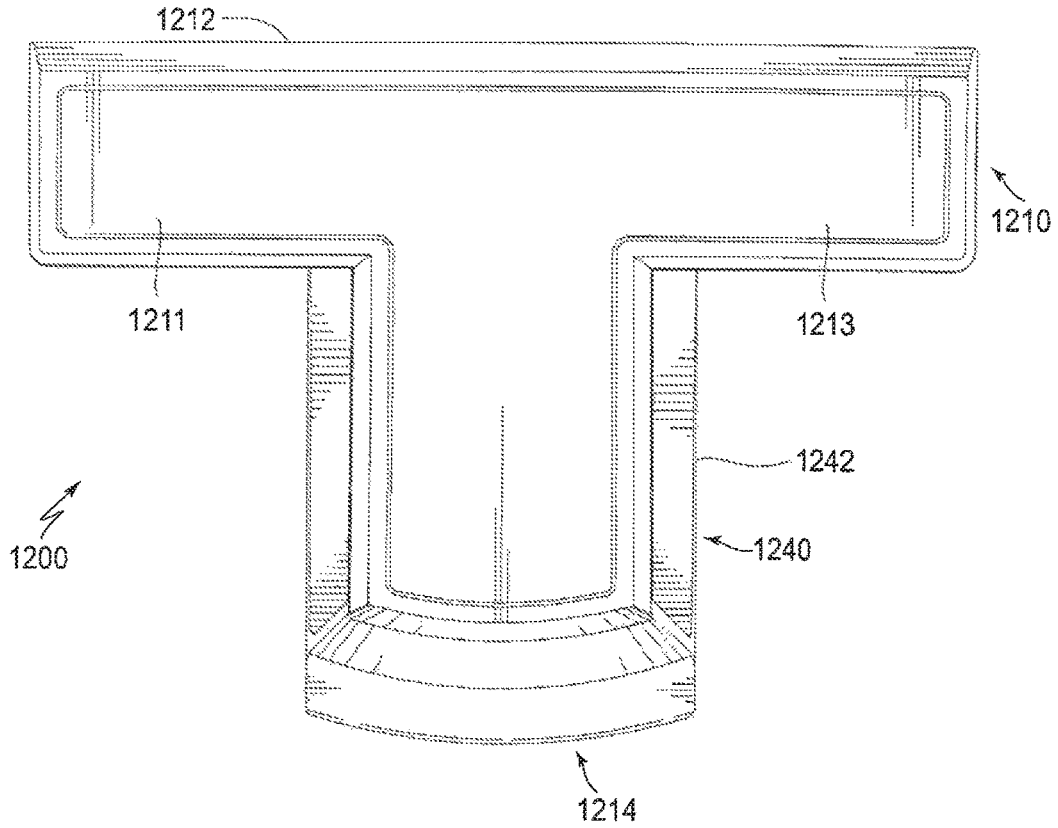
FIG. 31 shows a bottom plan view of the putter-type golf club head of FIG. 27.

As shown in FIGS. 30 and 31, the front member 1210 may comprise toe and heel muscles 1211, 1213 extending rearwardly from the striking surface 1212 toward the rear portion 1214. The upper surfaces of the toe and heel muscles 1211, 1213 may be lower (i.e., closer to the sole portion 1220) than the upper surface of the front member 1210 closer to the striking surface 1212. The upper surface of the front member 1210 closer to the striking surface 1212 may in turn be coplanar with the upper surface of the central elongate member 1240. As best shown in FIG. 31, the toe and heel muscles 1211, 1213 extend under (i.e., underlap) the top portion 1242 of the central elongate member 1240. Because the toe and heel muscles 1211, 1213 underlap the top portion 1242 in top plan view, distraction from a golfer's typical focal point is further prevented.

Figure 32:
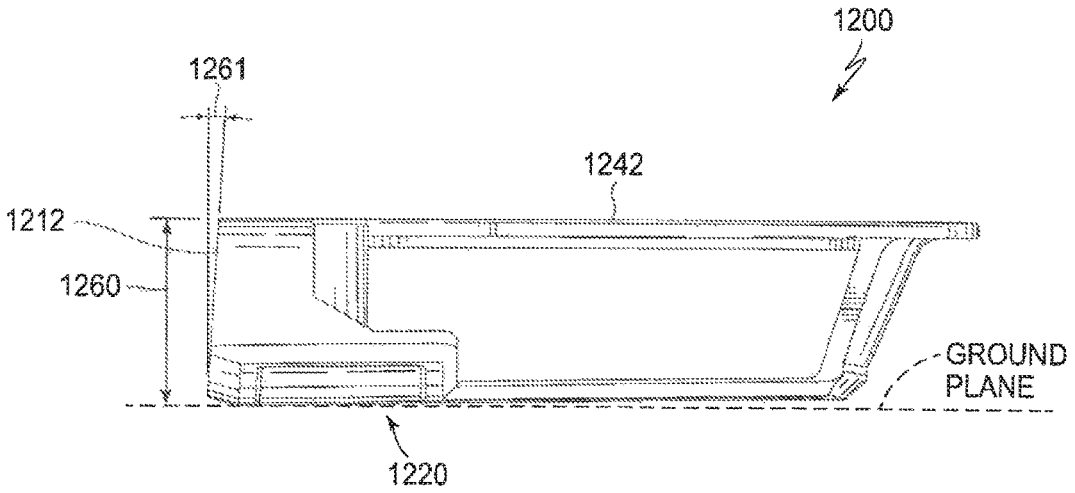
FIG. 32 shows a side view of the putter-type golf club head of FIG. 27.

Exemplary dimensions of the club head 1200 are described with reference to FIGS. 30 and 32. With reference to the "x" (i.e., front to rear) direction in FIG. 30, an overall length 1250 of the club head 1200 may be 3.56 in, and a length 1251 of the front member 1210 may be no less than 1.0 in, more preferably between 1.0 in and 2.0 in. With reference to the "y" (i.e., heel to toe) direction perpendicular to the "x" direction, the overall width 1252 of the club head 1200 may be 4.36 in, and the width 1256 of the central elongate member 1240 may be between 1.50 in and 2.25 in, more preferably between 1.70 in and 2.0 in, and even more preferably substantially equal to 1.82 in and/or slightly wider than the diameter of a conventional golf ball. Each edge of the square-shaped alignment elements 210, 240 on the central elongate member 1240 may have a length 1257 of 1.50 in, and the alignment elements 210, 240 may be separated from each other in the "x" direction by a distance 1259 no less than 0.75 in, and preferably equal to about 0.14 in. As shown in FIG. 32, the maximum height 1260 from the bottommost point of the sole portion 1220 to the uppermost point of the top portion 1242 of the central elongate member 1240 may be no greater than the diameter of a conventional golf ball, preferably no greater than 1.25 in, and more preferably equal to about 0.95 in. And the loft angle 1261 may be about 3°. In the club head 1200 having the above-described dimensions, the maximum width 1256 of the central elongate member 1240 may be greater than the diameter of a conventional golf ball. Additionally, the length 1257 of each edge of the alignment elements 210, 240 may be slightly less than the diameter of the conventional golf ball. This relationship may be advantageous because of the manufacturing requirement that sufficient space be provided around the edges of milled out alignment elements 210, 240.

The club head 1200 having the above-described dimensions possesses certain mass properties. For example, the mass of the club head 1200 may be 360 g. The mass of the club, including the club head 1200 and attached 34-in shaft, may be 540 g. And the moment of inertia $I_{ZZ}$ of the club head 1200 about an axis through the center of gravity of the club head 1200 and extending parallel to the z-axis may be, for example 4490 g*cm$^2$.

The club head 1200 thus has a head weight corresponding to that of a mallet-style putter, but by virtue of the shape of the front member 1210 and the position of the center of gravity of the club head 1200 relative to the shaft axis, the club head 1200 "feels" to the golfer like a blade-type putter. The club head 1200 may also be considered to be "face balanced." That is the striking surface 1212 of the club head 1200 may open less on the backstroke and may close less on the through-stroke in a golfer's putting motion. Putters having these properties are typically preferred by golfers who use a straight-back and straight-through putting stroke.

Figure 33:
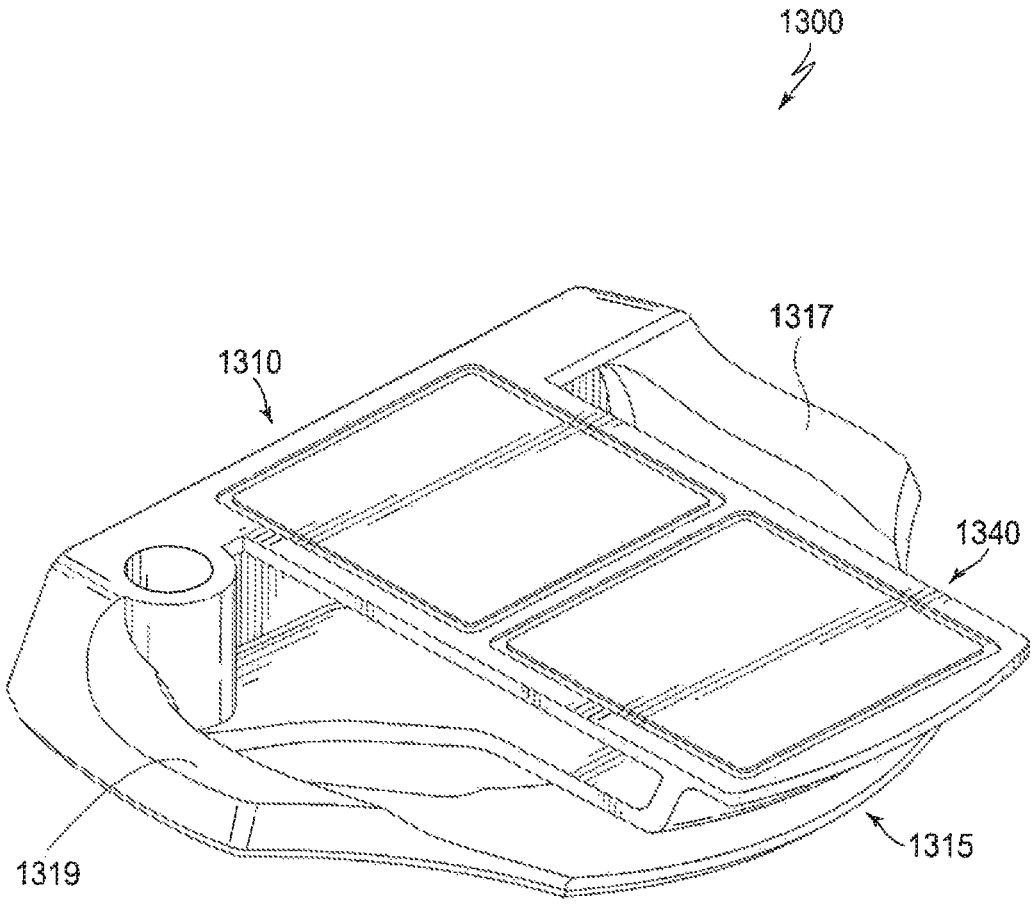
FIG. 33 shows a perspective view of an exemplary putter-type golf club head in accordance with one or more aspects of the present invention.
Figure 34:
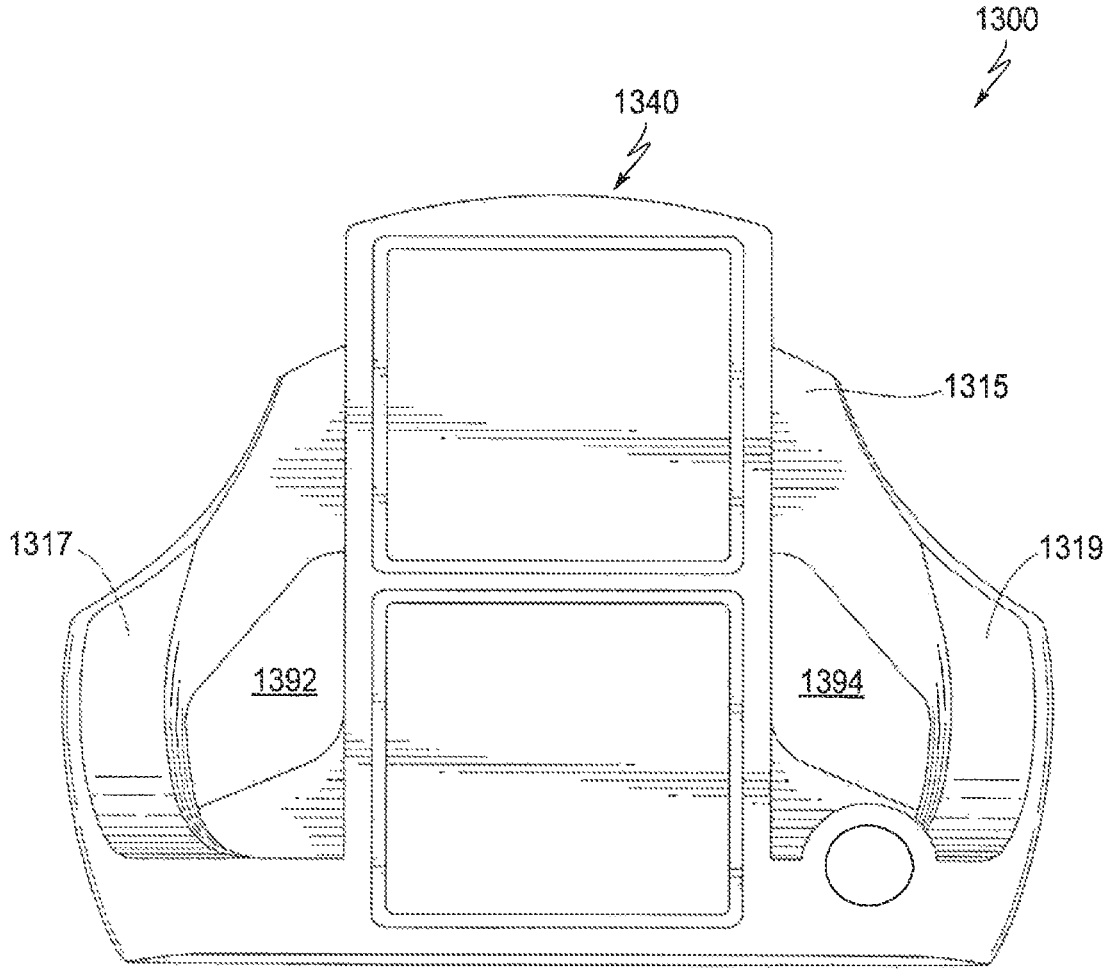
FIG. 34 shows a top plan view of the putter-type golf club head of FIG. 33.
Figure 35:
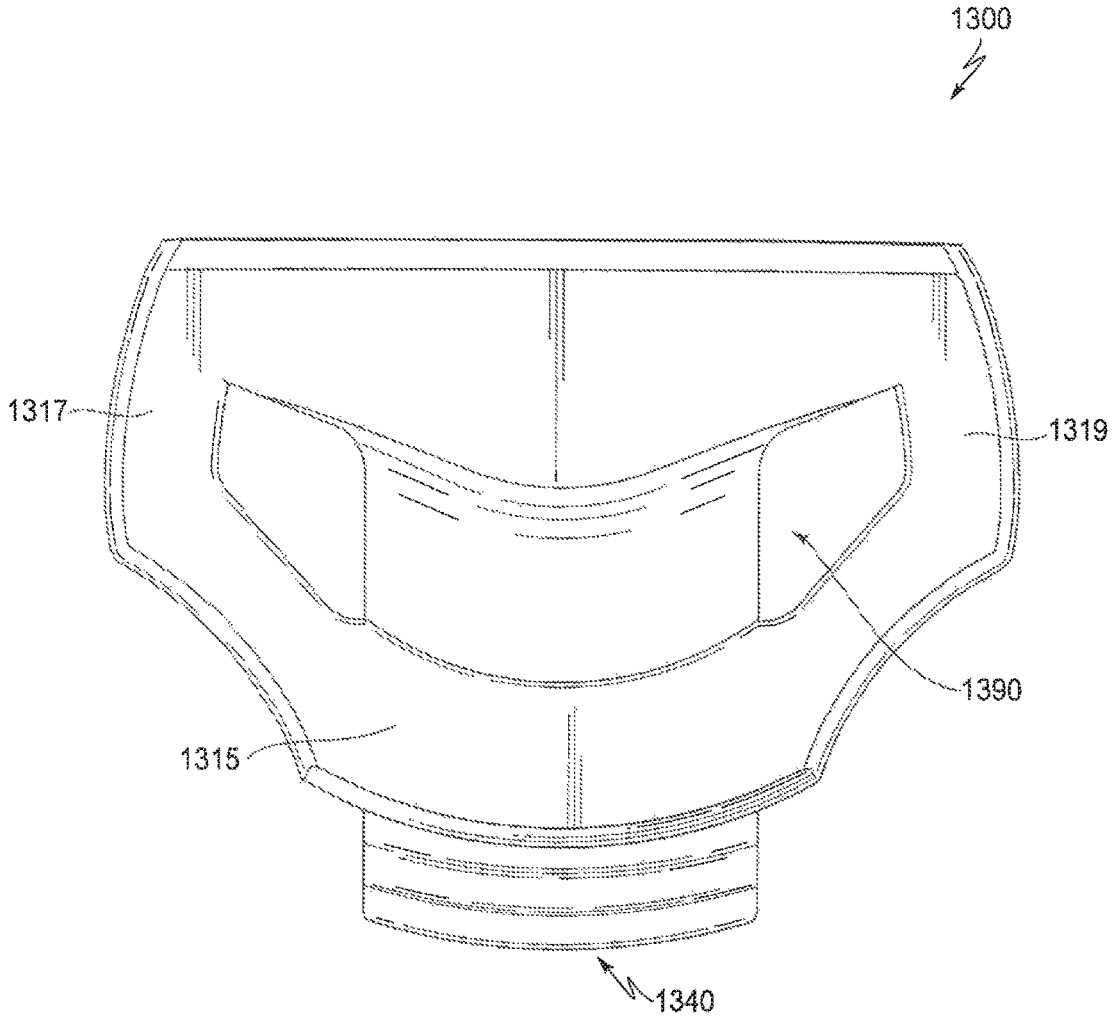
FIG. 35 shows a bottom plan view of the putter-type golf club head of FIG. 33.

FIGS. 33-35 show yet another non-limiting example 1300 of the golf club head according to the present disclosure. In the club head 1300, toe and heel arms 1317, 1319 are joined by a rear connecting portion 1315 so as to form a monolithic peripheral arc extending rearward from the front portion 1310. The central elongate member 1340 is positioned above, and vertically spaced from, the rear connecting portion 1315. As shown in FIG. 35, the toe arm 1317, heel arm 1319, and rear connecting portion 1315 form a single gap 1390 underneath the central elongate member 1340. But as shown in FIG. 34, when viewed in top plan view, the central elongate member 1340 obscures part of the gap 1390 so as to form toe and heel gaps 1392 and 1394 on opposite sides of the central elongate member 1340. This embodiment may permit a significant quantity of mass to be advantageously located about the periphery of the club head (e.g. via the monolithic peripheral arc) in a structurally and acoustically satisfactory manner. At the same time, this structure may result in a reduced quantity of material (and thus mass) necessary to provide the advantageous alignment features that may be presented on the top surface of the central elongate member 1340.

In the foregoing discussion, the present invention has been described with reference to specific exemplary aspects thereof. However, it will be evident that various modifications and changes may be made to these exemplary aspects without departing from the broader spirit and scope of the invention. For example, while the visual indicator section has been referred to as an edge, it should be appreciated that the visual indicator section can be any element capable of defining an orientation and length when viewed from above. Accordingly, the foregoing discussion and the accompanying drawings are to be regarded as merely illustrative of the present invention rather than as limiting its scope in any manner.

What is claimed is:

1. A putter-type golf club head that, when oriented in a reference position, comprises:

a main body comprising a blade member extending in a heel-to-toe direction and having a striking wall defining a substantially planar striking surface, and a central elongate member in communication with, and extending rearwardly from, the blade member, the central elongate member having an upper surface;

wherein:

the main body is formed of plural discrete components including a sole portion comprising a first material and a top portion comprising a second material different from the first material, the sole portion being recessed in its entirety from the upper surface of the central elongate member;

the upper surface of the central elongate member comprises at least one generally square-shaped alignment element; and the first material comprises a first density and the second material comprises a second density that is less than the first density.

2. The putter-type golf club head of claim 1, wherein the sole portion is secured to the top portion by a mechanical fastener.

3. The putter-type golf club head of claim 1, further comprising a resilient material sandwiched between the sole portion and the top portion.

4. The putter-type golf club head of claim 1, wherein the first material comprises stainless steel and the second material comprises aluminum.

5. The putter-type golf club head of claim 1, wherein the first material is harder than the second material.

6. The putter-type golf club head of claim 1, wherein the main body is substantially T-shaped.

7. The putter-type golf club head of claim 1, wherein:

the central elongate member further comprises a width, in the heel-to-toe direction, that is greater than a diameter of a golf ball; and the at least one alignment element comprises a width, in the heel-to-toe direction, that is slightly less than the diameter of the golf ball.

8. The putter-type golf club head of claim 1, wherein the club head is face-balanced.

9. A putter-type golf club head that, when oriented in a reference position, comprises:

a blade member extending in a heel-to-toe direction and having a striking wall defining a substantially planar striking surface;

a central elongate member in communication with, and extending rearwardly from, the blade member, the central elongate member comprising an upper surface having at least one generally square-shaped alignment element;

a cantilevered heel arm extending rearward from a heel-ward portion of the blade member; and a cantilevered toe arm extending rearward from a toe-ward portion of the blade member, wherein at least one of the heel arm and the toe arm tapers in thickness in the front-to-rear direction.

10. The putter-type golf club head of claim 9, further comprising:

a heel-ward gap defined between the heel arm and the central elongate member, the heel-ward gap having a first bend; and a toe-ward gap defined between the toe arm and the central elongate member, the toe-ward gap having a second bend.

11. The putter-type golf club head of claim 9, wherein the at least one generally square-shaped alignment element comprises at least two generally square-shaped alignment elements.

12. The putter-type golf club head of claim 9, wherein:

the central elongate member further comprises a width, in the heel-to-toe direction, that is greater than a diameter of a golf ball; and the at least one alignment element comprises a width, in the heel-to-toe direction, that is slightly less than the diameter of the golf ball.

13. The putter-type golf club head of claim 9, wherein the club head is face-balanced.

14. A putter-type golf club head that, when oriented in a reference position, comprises:

a blade member extending in a heel-to-toe direction and having a striking wall defining a substantially planar striking surface;

a central elongate member in communication with, and extending rearwardly from, the blade member, the central elongate member comprising an upper surface having at least one generally square-shaped alignment element;

a cantilevered heel arm secured to a rear portion of the central elongate member and projecting heel-wardly and forwardly of the rear portion; and a cantilevered toe arm secured to a toe-ward side of the rear portion of the central elongate member and projecting toe-wardly and forwardly of the rear portion, wherein the heel arm and the toe arm are formed in a unitary sole portion, the central elongate member is formed in a unitary top portion discrete from the sole portion, and the sole portion is mechanically coupled to the top portion.

15. The putter-type golf club head of claim 14, wherein the at least one generally square-shaped alignment element comprises at least two generally square-shaped alignment elements.

16. The putter-type golf club head of claim 14, wherein:

the central elongate member further comprises a width, in the heel-to-toe direction, that is greater than a diameter of a golf ball; and the at least one alignment element comprises a width, in the heel-to-toe direction, that is slightly less than the diameter of the golf ball.

17. The putter-type golf club head of claim 14, wherein the club head is face-balanced.

* * * * *